US006412125B1

(12) United States Patent
Ito et al.

(10) Patent No.: US 6,412,125 B1
(45) Date of Patent: Jul. 2, 2002

(54) HEAD/FACE WASHING DEVICE, SHOWER NOZZLE WITH HOOD, COMB-SHAPED SCALP WASHER AND HEAD WASHING SHOWER BRUSH

(75) Inventors: Kazumasa Ito; Mikito Tanaka; Nobuhiro Takeda; Toshiko Yokoi, all of Nagoya (JP)

(73) Assignee: Ricoh Elemex Corporation, Aichi (JP)

( * ) Notice: Subject to any disclaimer, the term of this patent is extended or adjusted under 35 U.S.C. 154(b) by 0 days.

(21) Appl. No.: 09/623,183

(22) PCT Filed: Aug. 3, 1999

(86) PCT No.: PCT/JP99/01111

§ 371 (c)(1),
(2), (4) Date: Aug. 29, 2000

(87) PCT Pub. No.: WO99/49751

PCT Pub. Date: Oct. 7, 1999

(30) Foreign Application Priority Data

Mar. 31, 1998 (JP) ..... 10-085382

(51) Int. Cl.[7] ..... A47K 3/28

(52) U.S. Cl. ..... 4/615; 239/69; 239/556; 601/169

(58) Field of Search ..... 4/567, 568, 570, 4/601, 615; 239/67, 69, 549, 556, 562; 601/160, 169; 607/82

(56) References Cited

U.S. PATENT DOCUMENTS 2,949,109 A * 8/1960 Koolnis ..... 4/615 X
3,651,523 A * 3/1972 Miyahara et al. ..... 4/615
5,065,942 A * 11/1991 Shannon ..... 4/615 X
6,042,027 A * 3/2000 Sandvik ..... 4/615 X

FOREIGN PATENT DOCUMENTS

| | | | |
|---|---|---|---|
| FR | 840117 | * 4/1939 | ..... 4/615 |
| JP | 61-147197 | 9/1986 | |
| JP | 4-6830 | 2/1992 | |
| JP | 4-18907 | 3/1992 | |
| JP | 6-52558 | 7/1994 | |
| JP | 6-72504 | 10/1994 | |
| JP | 7-255523 | 10/1995 | |
| JP | 8-24634 | 3/1996 | |
| JP | 3040281 | 5/1997 | |

* cited by examiner

*Primary Examiner*—Robert M. Fetsuga
(74) *Attorney, Agent, or Firm*—Foley & Lardner

(57) ABSTRACT

The head and face washing apparatus of the invention is designed to prevent scattering of fluid and enhance the washing efficiency. The head and face washing apparatus comprises pumps (103*a* to 103*d*) for supplying washing fluid through supply pipes (101*a* to 101*d*), plural spouts (105) for ejecting the washing fluid, and supply passages (106*a* to 106*d*) for supplying the washing fluid supplied through the supply pipes (101*a* to 101*d*) into the specified spout (105). Washing fluid is continuously pumped out from the pump (103*a*), while washing fluid is pumped out intermittently from the pumps (103*b* to 103*d*). As a result, a continuous water stream is ejected from the spout group (105*a*), and an intermittent water stream is ejected from the spout groups (105*b* to 105*d*).

12 Claims, 33 Drawing Sheets

(a)

(b)

(a)

(b)

(a)

(b)

HEAD/FACE WASHING DEVICE, SHOWER NOZZLE WITH HOOD, COMB-SHAPED SCALP WASHER AND HEAD WASHING SHOWER BRUSH

TECHNICAL FIELD

The present invention relates to head and face washing apparatus, shower nozzle with hood, comb type scalp washing tool, and head washing shower brush, and more particularly to head and face washing apparatus, shower nozzle with hood, comb type scalp washing tool, and head washing shower brush designed to prevent the liquid from scattering out of the washing area during washing.

BACKGROUND ART

In the bathroom, beauty parlor, hairdressing salon, and medical and care fields, various tools have been proposed so far as means for washing the head or other parts of the body.

A first prior art is a head washer disclosed in Japanese Laid-open Patent No. 7-255523. FIG. 37 is a schematic structural diagram showing this head washer. The head washer shown in FIG. 37 comprises a washing fluid storage tank 501 storing about 1 to 2 liters of washing fluid, a fluid feed pump 503 consisting of a motor 503*a* and a pressurizing unit 503*b* connected to the washing fluid storage tank 501 through a feed pipe 502, a main body 500 having a heater 504 for heating the washing fluid, and a nozzle body 506 connected at a free end of a fluid feed pipe 505 connected to the fluid feed pump 503 for ejecting the washing fluid supplied from the fluid feed pump 503. The outside of the nozzle body 506 is surrounded by a cover 508 having a slit (notch) 507 for dripping water.

In the head washer shown in FIG. 37, with the opening end of the cover 508 of the nozzle body 506 pressed to the head, the head can be washed by ejecting the washing fluid from the nozzle body 506. According to this head washer, since the nozzle body 506 is surrounded by the cover 508, the washing fluid bouncing back from the head hits against the inner wall of the cover 508 and falls, and scattering of the washing fluid can be prevented. Moreover, since the water dripping slit 507 is provided in the opening edge of the cover 508, the washing fluid in the cover 508 can be discharged outside through the slit 507, and the washing fluid is not collected much inside of the cover 508.

Although not shown, the nozzle body 506 incorporates a rotating element which is rotated by the pressure of the washing fluid, and it is designed so that the washing fluid flows into the nozzle holes of the nozzle body 506, that is, the ejection pressure of the washing fluid may be changed automatically. By disposing such rotating element in the nozzle body 506, the ejection pressure of the washing fluid may be changed, and the stimulation given to the head is varied, which makes it comfortable for the user.

A second prior art is a comb type scalp washing tool for discharging the fluid supplied through the fluid feed passage provided in the comb from plural discharge ports provided in the comb teeth. As an application of this comb type scalp washing tool, for example, the comb of such structure is mounted on the opening of a bottle container containing fluid such as hair liquid or hair coloring.

A third prior art is an oscillating hair washer disclosed in Japanese Laid-open Utility Model No. 6-52558. FIG. 38 shows an appearance of this oscillating hair washer. The oscillating hair washer has an oscillating source and dry battery contained in a waterproof handle 600, and feeble vibration is transmitted from the oscillating source to the bristles 602 of an oscillating brush 601. When using a shampoo in this oscillating hair washer, by the force of the bristles 602 hitting against the scalp and hair root, and the rubbing action by vibration with shampoo, stains in the hair root and scalp can be washed away.

A fourth prior art is a hair washing brush disclosed in Japanese Laid-open Utility Model No. 6-72504. FIG. 39(*a*) is a side view of this hair washing brush, and FIG. 39(*b*) is a bottom view showing the configuration of brush protrusions of this hair washing brush. This hair washing brush is composed by forming brush protrusions 701 made of synthetic resin on a brush base 700, and the density of the brush protrusions 701 gradually increases from the leading end to the rear end of the brush base 700 along the moving direction when washing (the arrow direction in the drawing). With this hair washing brush, the hair staining can be removed securely with water only, not using shampoo.

However, in the first prior art, by covering the nozzle body, the washing fluid hitting against the head is prevented from scattering outside, but in order to obtain the effect of prevention of scatter of washing fluid, the cover opening end must be pressed against the head while washing, and since the hair is pressed down by the cover, the washing fluid does not hit against the scalp directly. Therefore, in the first prior art, a sufficient washing effect could not be obtained. In addition, since the cover is fitted against the head during use, it is not comfortable, and there is a sanitary problem.

Also in the first prior art, the nozzle body incorporates the rotating element which changes the ejection pressure of washing fluid to change the stimulation given to the head, but this rotating element is rotated by receiving pressure of the washing fluid before the nozzle holes and changes the ejection pressure of washing fluid, and it causes loss in the entire ejection pressure in order to rotate this rotating element.

Also in the first prior art, since the cover and rotating element are disposed on the nozzle body, the nozzle body is large in size and increases in weight, and it is not convenient to use.

Also in the first prior art, although scatter of water is prevented by the cover provided in the nozzle body, the water collected inside the cover is discharged through the slit (notch), it is difficult to keep balance between the cover slit size and discharge water volume, and it is not convenient to use. More specifically, for example, depending on the water discharge volume from the nozzle body, the water may be collected in the cover and the discharge water pressure may be weak, or the washing effect is lowered. If the slit size is increased for discharging, depending on the discharge water pressure from the nozzle body, water may splash out from the slit and the role of the cover is lost, or if the discharge water pressure from the nozzle body is adjusted to such an extent as not to splash water, the washing effect is lowered.

In the second prior art, the fluid discharged on the scalp bounces back, and scatters about. To eliminate such problem, in the comb type scalp washing tool of the second prior art, the cover as in the first prior art may be used to prevent scattering of fluid, but since it is impossible to change the height of the cup-shaped cover in the vertical direction to the scalp surface, when washing the scalp while combing the hair, it is difficult to follow up the uneven surface of the scalp depending on bulkiness and thickness of the hair. In addition, the cup-shape cover hinders, and the combing depth and comb angle cannot be changed, and the degree of freedom is sacrificed.

When the oscillating hair washer and hair washing brush of the third prior art and fourth prior art are used in washing of the scalp, the washing fluid is blocked by the hair and does not reach up to the scalp, and sufficient washing effect is not obtained. Besides, there is no means for ejecting by receiving supply of fluid, rinsing while brushing is not enabled. In addition, if such means for ejecting by receiving supply of fluid is provided, it requires extra means for preventing bouncing of the fluid ejected toward the scalp.

The invention is devised in the light of the above problems, and it is hence an object thereof to present a head and face washing apparatus capable of preventing scattering of washing fluid by other method than cover.

It is also an object to present a head and face washing apparatus capable of enhancing the washing efficiency while preventing scattering of washing fluid by other method than cover.

It is other object to present a head and face washing apparatus capable of giving a comfortable feeling to the user without loss of ejection pressure of washing fluid.

It is a different object to present a head and face washing apparatus with washing fluid scattering preventive effect and massage effect, reduced in size and weight of the fluid ejecting means such as shower head, and capable of enhancing the ease of handling.

It is also an object to present a head and face washing apparatus capable of enhancing the washing efficiency and massage effect in a simple configuration.

It is a further object to present a shower nozzle with hood capable of preventing scattering of water and discharging water adequately, regardless of the water discharge pressure and discharge volume from the nozzle.

It is a further object to present a comb type scalp washing tool capable of preventing scattering of fluid without impeding the motion of the comb.

It is a further object to present a head washing shower brush capable of applying fluid directly on the scalp so as to wash or rinse while brushing.

It is a further object to present a head washing shower brush capable of applying fluid directly on the scalp, sucking the applied fluid immediately to prevent scattering of fluid, and also preventing the fluid from leaking outside.

DISCLOSURE OF THE INVENTION

A head and face washing apparatus of the invention comprises fluid feed means for supplying fluid through a fluid feed passage, and fluid ejecting means connected to the fluid feed passage, for ejecting the fluid supplied from the fluid feed means, in which the fluid feed passage at least includes first and second fluid feed passages, and the fluid feed means includes first fluid feed means for supplying fluid through the first fluid feed passage and second fluid feed means for supplying fluid through the second fluid feed passage.

According to this head and face washing apparatus, the first fluid feed means supplies the fluid into the fluid ejecting means through the first fluid feed passage, and the second fluid feed means supplies the fluid into the fluid ejecting means through the second fluid feed passage, and therefore the fluid can be ejected from the fluid ejecting means in at least two different methods.

A head and face washing apparatus of the invention relates to the head and face washing apparatus, in which the fluid ejecting means is a shower head having plural spouts for ejecting the fluid, a first supply passage for supplying the fluid supplied through the first fluid feed passage into the specified spouts, and a second supply passage for supplying the fluid supplied through the second fluid feed passage into the specified spouts, the first fluid feed means supplies the fluid continuously through the first fluid feed passage, the second fluid feed means supplies the fluid intermittently through the second fluid feed passage, the first supply passage supplies the fluid supplied through the first fluid feed passage into the spout disposed on the outer circumference of the shower head, and the second supply passage supplies the fluid supplied through the second fluid feed passage into the other spouts than the spouts supplied with the fluid from the first supply passage.

According to this head and face washing apparatus, the first fluid feed means supplies the fluid continuously into the first supply passage through the first fluid feed passage, and the first supply passage supplies the fluid supplied through the first fluid feed passage into the spout disposed on the outer circumference of the shower head, and therefore a wall by continuous water stream for preventing scattering of fluid is formed on the outer circumference of the shower head. Moreover, the second fluid feed means supplies the fluid intermittently into the second supply passage through the second fluid feed passage, and the second supply passage supplies the fluid supplied through the second fluid feed passage into the other spouts than the spouts supplied with the fluid from the first supply passage, and therefore it is possible to wash by using an intermittent water stream of excellent washing property in the state of prevention of scattering of fluid by the wall of a continuous water stream.

A head and face washing apparatus of the invention relates to the head and face washing apparatus, in which the second fluid feed means, second fluid feed passage, and second supply passage are individually provided in a plurality to correspond to each other, further comprising supply timing control means for controlling the intermittent supply timing of the fluid in every one of the plural second fluid feed means.

According to this head and face washing apparatus, the supply timing control means controls the intermittent supply timing of the fluid in every one of the plural second fluid feed means, and therefore fluid ejection timing from the shower head can be controlled.

A head and face washing apparatus of the invention relates to the head and face washing apparatus, further comprising fluid feed control means for adjusting the peak water pressure of the fluid supplied intermittently from the second fluid feed means and ejected from the spouts of the shower head in a range of 3 to 7 $kg/cm^2$, and adjusting the reference number of intermittent pulses for supplying the fluid intermittently in the second fluid feed means in a range of 1600 to 2000 pulses per minute.

According to this head and face washing apparatus, the fluid feed control means adjusts the peak water pressure of the fluid supplied intermittently from the spouts of the shower head and the reference number of intermittent pulses for supplying the fluid intermittently in a range excellent in the washing effect and sense of use.

A head and face washing apparatus relates to the head and face washing apparatus, in which the first and second fluid feed means supply the fluid intermittently through the corresponding first and second fluid feed passages, further comprising supply timing control means for controlling the intermittent supply timing of the fluid individually in the first and second fluid feed means.

According to this head and face washing apparatus, the supply timing control means controls the first and second fluid feed means, and therefore controls the ejection timing of the fluid supplied intermittently by the first and second fluid feed means.

A head and face washing apparatus of the invention comprises fluid feed means for supplying fluid through a fluid feed passage, and fluid ejecting means connected to the fluid feed passage, for ejecting the fluid supplied from the fluid feed means, further comprising fluid feed control means for controlling the fluid feed means so that the water pressure of the fluid ejected from the spout of the fluid ejecting means may be in a range of 3 to 7 kg/cm$^2$.

According to this head and face washing apparatus, the fluid feed control means controls the fluid feed means, and therefore the water pressure of the fluid ejected from the spout of the fluid ejecting means may be controlled in a range of high washing effect and massage effect.

A head and face washing apparatus of the invention relates to the head and face washing apparatus, in which the fluid feed means supplies the fluid intermittently through the fluid feed passage.

According to this head and face washing apparatus, the intermittent water stream high in washing effect and massage effect can be used.

A head and face washing apparatus of the invention relates to the head and face washing apparatus, in which the fluid feed control means controls the fluid feed means so that the reference number of intermittent pulses for supplying the fluid intermittently may be in a range of 600 to 2000 pulses per minute.

According to this head and face washing apparatus, the fluid feed control means controls the fluid feed means, and therefore the fluid can be supplied intermittently at intervals high in the washing effect and massage effect.

A shower nozzle with hood of the invention is a shower nozzle with hood having a hood for preventing scattering of water in order to prevent the water discharged from the discharge port of the shower nozzle from scattering out of the washing area, in which the hood for preventing scattering of water is made of a mesh material.

According to this shower nozzle with hood, the hood for preventing scattering of water is made of a mesh material, and therefore scattering of water can be prevented and also water can be discharged appropriately.

A shower nozzle with hood of the invention is a shower nozzle with hood having a hood for preventing scattering of water in order to prevent the water discharged from the discharge port of the shower nozzle from scattering out of the washing area, in which the hood for preventing scattering of water is made of a mesh material disposed in multiple layers, with a space layer interposed between the layers.

According to this shower nozzle with hood, the hood for preventing scattering of water is made of a mesh material disposed in multiple layers, with a space layer interposed between the layers, and therefore scattering of water can be prevented and also water can be discharged appropriately.

A shower nozzle with hood of the invention is a shower nozzle with hood having a hood for preventing scattering of water in order to prevent the water discharged from the discharge port of the shower nozzle from scattering out of the washing area, in which the hood for preventing scattering of water is made of a porous material.

According to this shower nozzle with hood, the hood for preventing scattering of water is made of a porous material, and therefore scattering of water can be prevented and also water can be discharged appropriately.

A shower nozzle with hood of the invention is a shower nozzle with hood having a hood for preventing scattering of water in order to prevent the water discharged from the discharge port of the shower nozzle from scattering out of the washing area, in which the hood for preventing scattering of water includes a first layer made of a soft porous material and a second layer made of a stiff porous material, and the outside of the first layer near the discharge port is covered with the second layer.

According to this shower nozzle with hood, the hood for preventing scattering of water includes a first layer made of a soft porous material and a second layer made of a stiff porous material, and the outside of the first layer near the discharge port is covered with the second layer, and therefore scattering of water can be prevented and also water can be discharged appropriately.

A shower nozzle with hood of the invention is a shower nozzle with hood having a hood for preventing scattering of water in order to prevent the water discharged from the discharge port of the shower nozzle from scattering out of the washing area, in which the hood for preventing scattering of water includes a first layer made of a mesh material and a second layer made of a porous material, with a space layer disposed between the first layer and second layer.

According to this shower nozzle with hood, the hood for preventing scattering of water includes a first layer made of a mesh material and a second layer made of a porous material, with a space layer disposed between the first layer and second layer, and therefore scattering of water can be prevented and also water can be discharged appropriately.

A shower nozzle with hood of the invention relates to the shower head with hood, in which the hood for preventing scattering of water is formed in a cylindrical shape gradually increasing in the inside diameter from the discharge port side of the shower nozzle toward the washing area side.

According to this shower nozzle with hood, the hood for preventing scattering of water is formed in a cylindrical shape gradually increasing in the inside diameter from the discharge port side of the shower nozzle toward the washing area side, and therefore the water hitting area can be changed while the hood is abutting against the washing area.

A shower nozzle with hood of the invention relates to the shower head with hood, in which the hood for preventing scattering of water can be detached from the shower nozzle.

According to this shower nozzle with hood, the hood for preventing scattering of water can be detached from the shower nozzle, and therefore, for example, the hood can be replaced.

A comb type scalp washing tool of the invention is a comb type scalp washing tool for discharging the fluid supplied through the fluid feed passage in the comb from plural discharge ports provided in the comb teeth, in which a cover is provided at a position for enclosing the plural discharge ports at least at positions before and after in the comb moving direction, being variable in the height in the vertical direction to the scalp side so as to follow up the scalp surface.

According to this comb type scalp washing tool, a cover for preventing scattering of fluid is provided at a position for enclosing the plural discharge ports at least at positions before and after in the comb moving direction, being variable in the height in the vertical direction to the scalp side so as to follow up the scalp surface, and therefore scattering of fluid can be prevented as the cover follows up the scalp surface.

A comb type scalp washing tool of the invention relates to the comb type scalp washing tool, in which the cover can be detached from the comb.

According to this comb type scalp washing tool, the cover can be detached from the comb, and therefore, for example, the comb and cover can be cleaned easily.

A comb type scalp washing tool of the invention relates to the comb type scalp washing tool, in which the cover is made of a plastic film.

According to this comb type scalp washing tool, the cover is made of a plastic film, and therefore, for example, the comb type scalp washing tool may be lower in cost, reduced in weight, and facilitated in manufacture.

A comb type scalp washing tool of the invention relates to the comb type scalp washing tool, in which the cover is like a brush.

According to this comb type scalp washing tool, the cover is like a brush, and therefore the combing motion is not impeded, and the feeling of use is soft.

A head washing shower brush of the invention is a head washing shower brush having a plurality of comb teeth on a brush base for washing the head by using the comb teeth, comprising plural ejecting means disposed at the side of the plurality of comb teeth of the brush base for ejecting the fluid supplied from outside, and plural sucking means disposed so as to surround the plurality of comb teeth at the side of the plurality of comb teeth of the brush base for sucking he fluid ejected by the ejecting means from outside.

According to this head washing shower brush, plural ejecting means are disposed at the side of the plurality of comb teeth of the brush base for ejecting the fluid supplied from outside, and plural sucking means are disposed so as to surround the plurality of comb teeth at the side of the plurality of comb teeth of the brush base for sucking he fluid ejected by the ejecting means from outside, and therefore the fluid can be sucked while applying the fluid directly in the washing area.

A head washing shower brush of the invention is the head washing shower brush, in which the sucking means are made of flexible tubes.

According to this head washing shower brush, the sucking means are made of flexible tubes, and therefore it can follow up the uneven surface of the washing area.

A head washing shower brush of the invention is the head washing shower brush, in which the flexible tubes are formed to have at least two different lengths.

According to this head washing shower brush, the flexible tubes are formed to have at least two different lengths, and therefore the fluid sucking positions can be varied.

A head washing shower brush of the invention is the head washing shower brush, in which the flexible tubes are formed so that the opening of the leading end side may be directed to the comb tooth side.

According to this head washing shower brush, the flexible tubes are formed so that the opening of the leading end side may be directed to the comb tooth side, and therefore the fluid can be sucked effectively.

A head washing shower brush of the invention is the head washing shower brush, further comprising a flexible cover for surrounding the plurality of comb teeth provided at the side of the plurality of comb teeth of the brush base, in which the sucking means have suction ports provided at the lowest position of the flexible cover and fluid passages for sucking the fluid sucked from the suction ports along the flexible cover.

According to this head washing shower brush, further comprising a flexible cover for surrounding the plurality of comb teeth provided at the side of the plurality of comb teeth of the brush base, in which the sucking means have suction ports provided at the lowest position of the flexible cover and fluid passages for sucking the fluid sucked from the suction ports along the flexible cover, and therefore the fluid is prevented from leaking outside.

BEST MODE FOR CARRYING OUT THE INVENTION

Preferred embodiments of the head and face washing apparatus, shower nozzle with hood, comb type scalp washing tool, and head washing shower brush of the invention are described in detail below while referring to the accompanying drawings.

First, as embodiments 1 and 2 of the invention, the head and face washing apparatus of the invention is explained.

Figure 1:
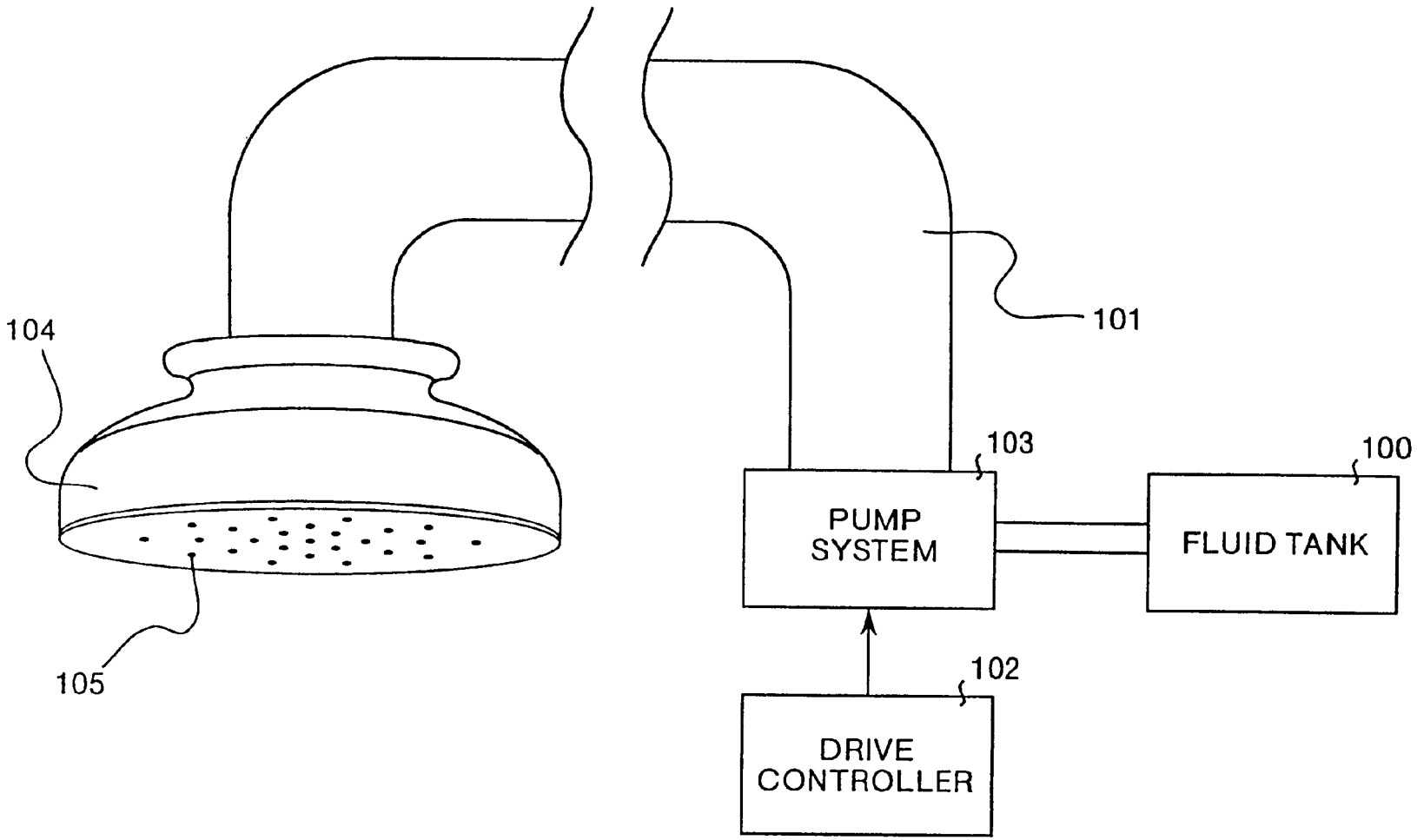
FIG. 1 is a schematic outline view of a head and face washing apparatus according to embodiment 1 of the invention.

FIG. 1 is a schematic diagram showing an outline structure of the head and face washing apparatus in embodiment 1. This head and face washing apparatus comprises a fluid tank 100 for storing washing fluid (liquid), a pump system 103 for pumping the washing fluid supplied from the fluid tank 100 through a flexible supply pipe 101 under control of a drive controller 102, and a shower head 104 connected to the supply pipe 101 for ejecting the washing fluid supplied from the pump system 103 from a spout 105. In FIG. 1, instead of the fluid tank 100, a faucet may be connected to the pump system 103.

The fluid tank 100 and pump system 103 correspond to the fluid feed means of the invention, the supply pipe 101 corresponds to the fluid feed passage of the invention, the shower head 104 and spout 105 correspond to the fluid ejecting means of the invention, and the drive controller 102 corresponds to the supply timing control means and fluid feed control means of the invention.

Figure 2:
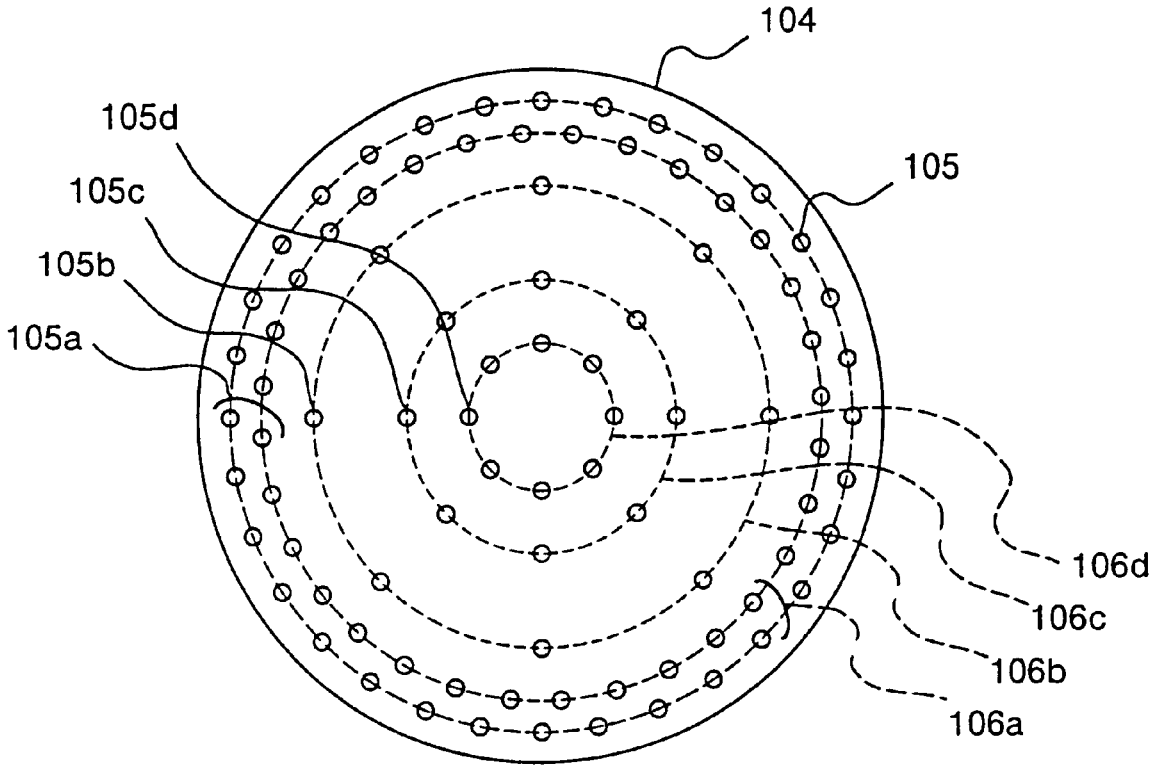
FIG. 2 is a plan of the head and face washing apparatus of embodiment 1, showing the shower head from the spout side.
Figure 3:
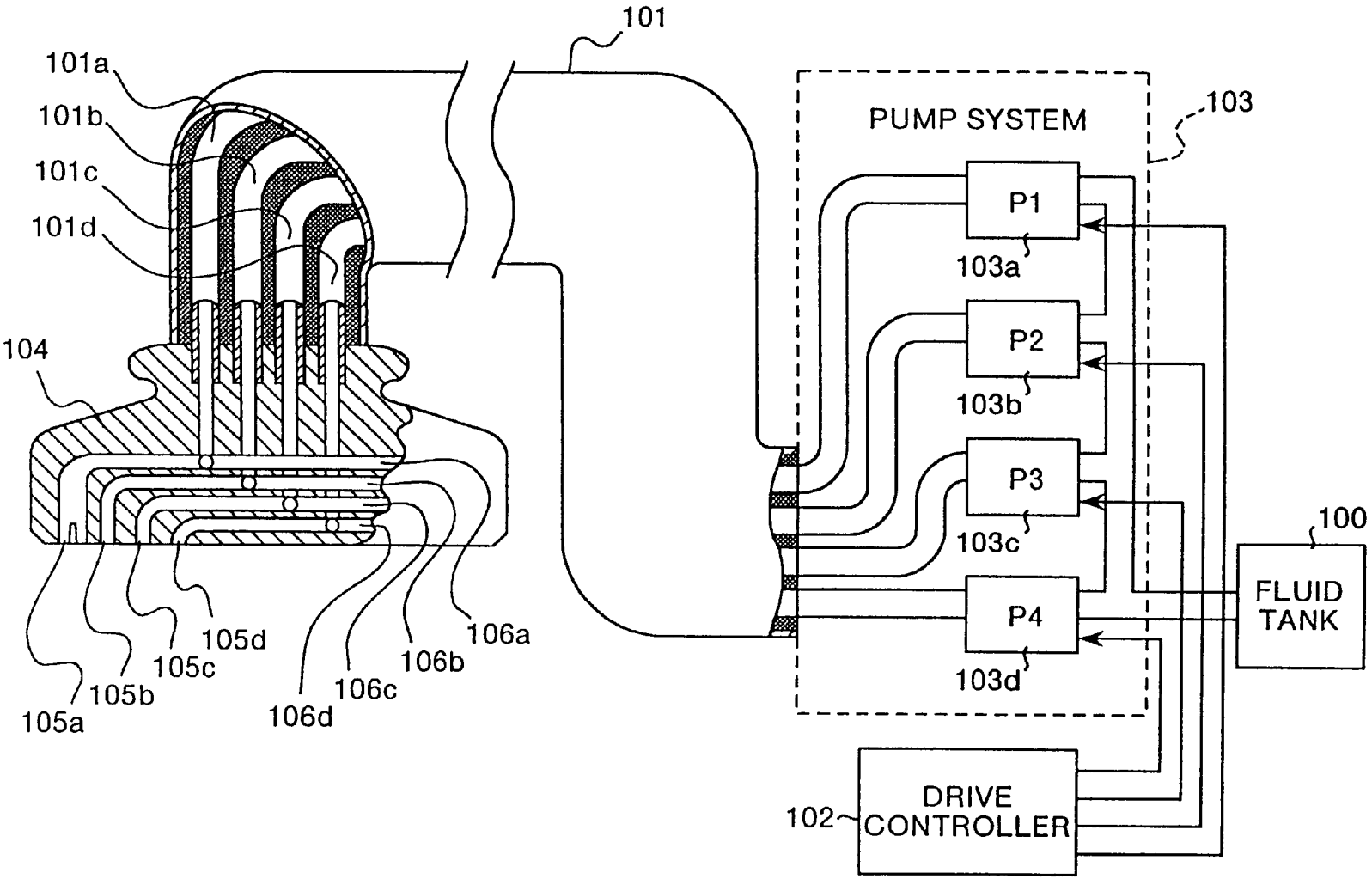
FIG. 3 is an explanatory diagram showing an internal structure of the head and face washing apparatus of embodiment 1.

FIG. 2 is a plan of the shower head 104 as seen from the spout 105 side, and FIG. 3 is an explanatory diagram showing the internal structure of the head and face washing apparatus shown in FIG. 1. In FIG. 2 and FIG. 3, reference numerals 105*a* to 105*d* denote spout groups having the spouts 105 of the shower head 104 divided into groups according to the method of water feed as described below, specifically 105*a* showing a spout group composed of plural spouts 105 arranged in two rows from the outer circumference of the shower head 104 toward the inside, 105*b* showing a spout group composed of plural spouts 105 arranged in one row at the inner side from the spout group 105*a*, 105*c* showing a spout group composed of plural spouts 105 arranged in one row at the inner side from the spout group 105*b*, and 105*d* showing a spout group composed of plural spouts 105 arranged in one row at the innermost side.

Reference numerals 106*a* to 106*d* show supply passages (corresponding to the first and second supply passages of the invention) formed inside of the shower head 105 for supplying the washing fluid into each spout 105, specifically 106*a* showing a supply passage communicating with each spout 105 of the spout group 105*a*, 106*b* showing a supply passage communicating with each spout 105 of the spout group 105*b*, 106*c* showing a supply passage communicating with each spout 105 of the spout group 105*c*, and 106*d* showing a supply passage communicating with each spout 105 of the spout group 105*d*.

Reference numerals 101*a* to 101*d* show supply pipes (corresponding to the first and second fluid feed passages of the invention) for supplying the washing fluid from the pump system 103 into each one of the supply passages 106*a* to 106*d* of the shower head 104, specifically 101*a* showing a supply pipe communicating with the supply passage 106*a*, 101*b* showing a supply pipe communicating with the supply passage 106*b*, 101*c* showing a supply pipe communicating with the supply passage 106*c*, and 101*d* showing a supply pipe communicating with the supply passage 106*d*.

Reference numerals 103*a* to 103*d* show pumps for composing the pump system 103 (corresponding to the first and second fluid feed means of the invention), specifically 103*a* showing a pump connected to the supply pipe 101*a*, 103*b* showing a pump connected to the supply pipe 101*b*, 103*c* showing a pump connected to the supply pipe 101*c*, and 103*d* showing a pump connected to the supply pipe 101*d*.

Outline of operation of the head and face washing apparatus having such configuration is explained. Herein, for example, continuous water stream flows out from the spouts 105 of the spout group 105*a*, and intermittent water stream, from other spouts 105.

The operation of flow of continues water stream from each spout 105 of the spout group 105*a* is explained. Under the control of the drive controller 102, the pump 103*a* pumps the washing fluid in the fluid tank 100 continuously into the supply pipe 101*a*. The pumped washing fluid flows into the supply passage 106*a* in the shower head 104 from the supply pipe 101*a*, and comes out from each spout 105 of the spout group 105*a*.

Continuous water stream flowing out from each spout 105 of the spout group 105*a* is intended to form a wall for prevention of scattering of washing fluid. In particular, as shown in FIG. 2, the reason of the number of spouts 105*a* of the spout group 105*a* greater than the number of spouts 105 of other group is to form this wall. However, to prevent bouncing of continuous water stream from each spout 105 of the spout group 105*a*, it is preferred to form a continuous water stream at water pressure of 3 kg/cm$^2$ or less. Therefore, instead of the pump 103*a*, tap water may be connected directly.

The operation of flow of intermittent water stream from each spout 105 of other spout groups 105*b* to 105*d* is same as in the case of continuous water stream except that the pumps 103*b* to 103*d* pump out washing fluid intermittently to the supply pipes 101*b* to 101*d*. Intermittent water stream may be also formed by a reciprocating pump or the like.

Herein, the intermittent water stream is used in the spout groups 105*b* to 105*d* because the washing efficiency is higher in the intermittent water stream. On the other hand, the intermittent water stream is likely to bounce back from the scalp, but it is shielded by the wall of the continuous water stream formed by the spout group 105*a* and does not scatter outside.

In the head and face washing apparatus of embodiment 1, since different pumps 103*a* to 103*d* are used in each spout group, and the washing fluid can be ejected at different timings in each spout group. The ejecting timing is explained below by referring to the timing chart.

Figure 4:
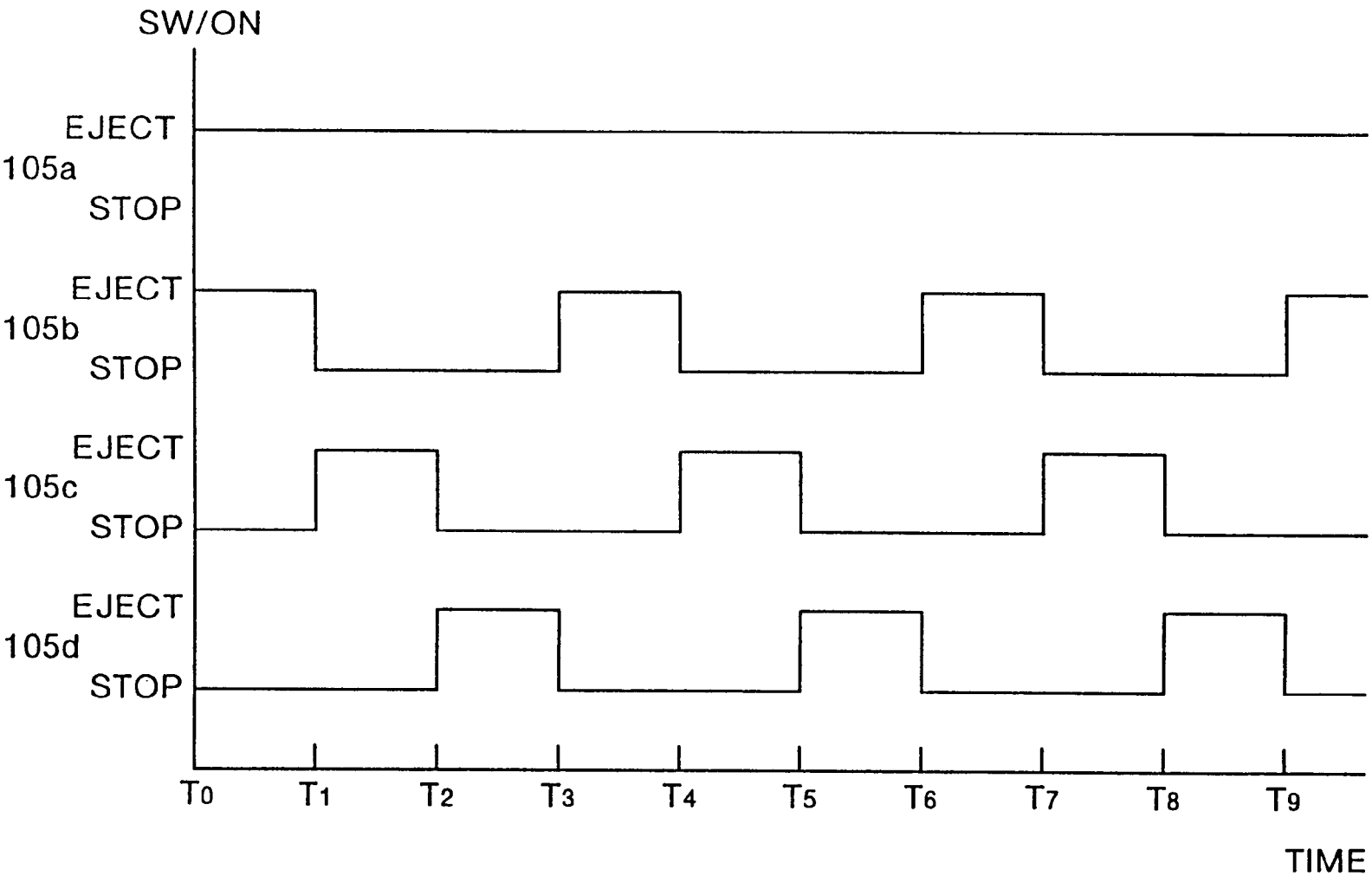
FIG. 4 is a timing chart showing an example of timing control of eject/stop in every spout group in the head and face washing apparatus of embodiment 1.

FIG. 4 is a timing chart showing an example of timing control of eject/stop in each spout group, showing a control signal to each pump from the drive controller 102. In FIG. 4, at time T0, the washing fluid is ejected from the spout groups 105*a* and 105*b*, and a continuous water stream is continuously flowing out from the spout group 105*a*. At T1, ejection from the spout group 105*a* is stopped, and washing fluid flows out from the spout group 105*c* instead. At T2, ejection from the spout group 105*c* is stopped, and washing fluid flows out from the spout group 105*d* instead. At T3, ejection from the spout group 105*d* is stopped, and washing fluid flows out from the spout group 105*b* again. By repeating this control while washing the scalp, sensation of the move of enjection from outside to inside gives a massage effect, thereby presenting a comfortable feeling to the user.

Figure 5:
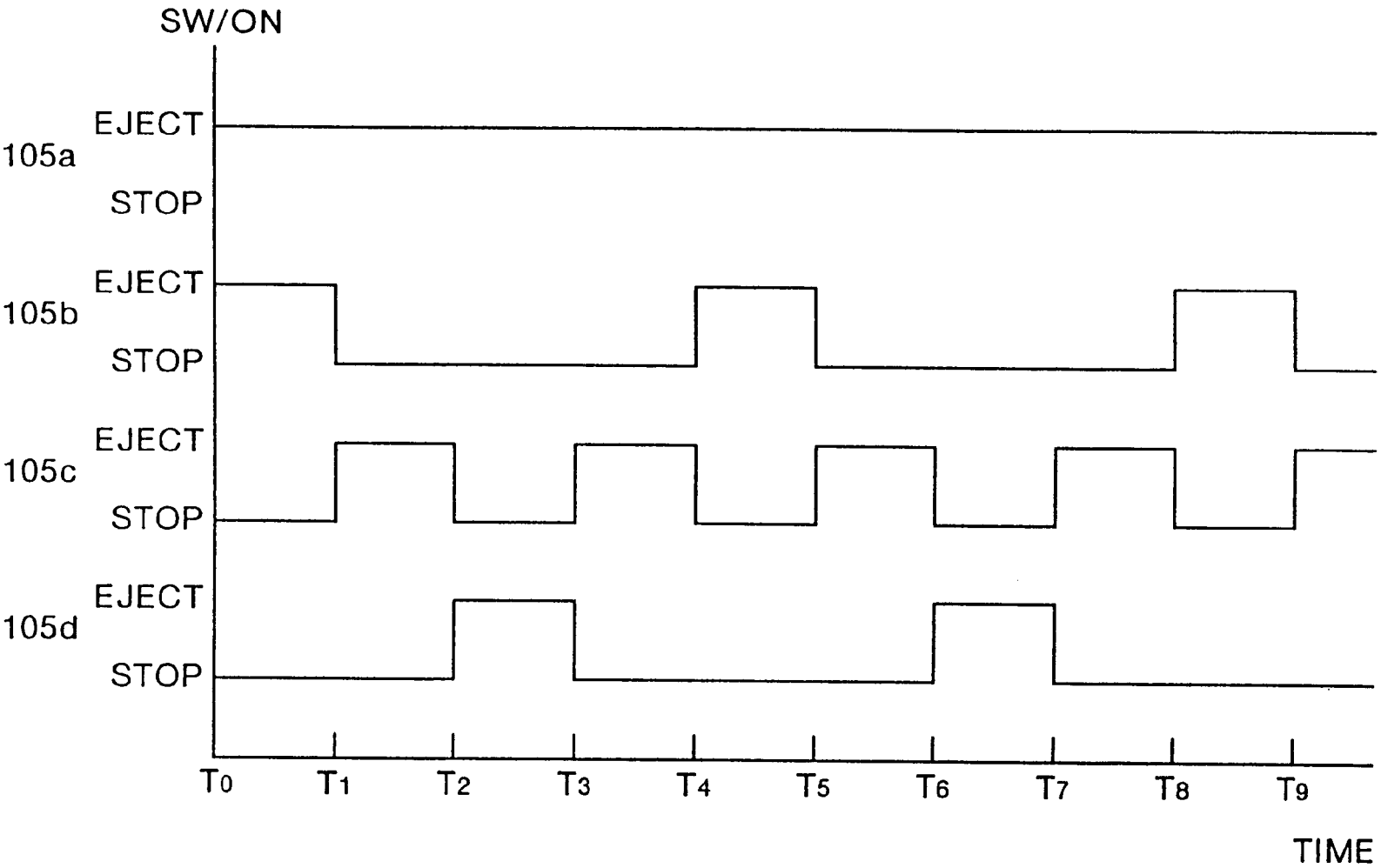
FIG. 5 is a timing chart showing another example of timing control of eject/stop in every spout group in the head and face washing apparatus of embodiment 11.
Figure 6:
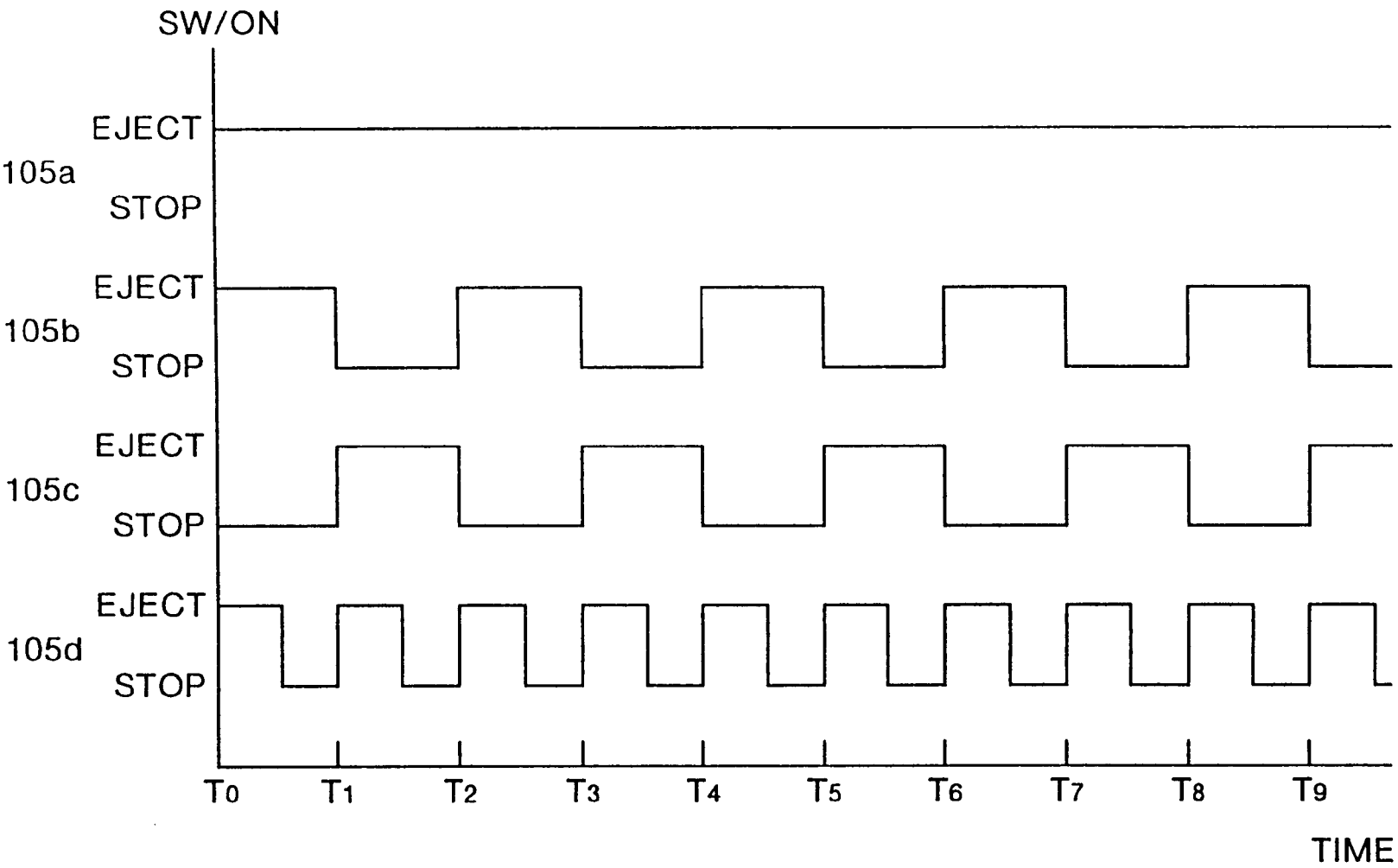
FIG. 6 is a timing chart showing a different example of timing control of eject/stop in every spout group in the head and face washing apparatus of embodiment 1.

FIG. 5 and FIG. 6 are timing charts showing other examples of timing control of eject/stop in each spout group. The timing chart in FIG. 5 shows the change of ejection position from outside to inside, and from inside to outside of the shower head, in the sequence of spout group 105*b*, spout group 105*c*, spout group 105*d*, spout group 105*c*, and spout group 105*b*. From the spout group 105*a*, a continuous water stream is ejected.

The timing chart in FIG. 6 shows shortening of the period of eject/stop in the spout group 105*d*, by ejecting alternately from the spout group 105*b* and spout group 105*d*.

As clear from FIG. 4 to FIG. 6, by the control by the drive controller 102, the ejection timing of intermittent water stream and the position of ejecting spouts 105 can be changed, and eject/stop can be controlled in various patterns, and the massage effect is improved. Moreover, when the drive controller 102 is designed so that the eject/stop pattern can be selected by the user, the washing fluid may be ejected in a pattern suited to the preference of the user, so that the convenience of the head and face washing apparatus may be enhanced.

In the head and face washing apparatus of embodiment 1, the peak water pressure of washing fluid by intermittent ejection of washing fluid from the spouts 105 of the shower head 104, and the reference number of intermittent pulses for intermittent ejection of washing fluid by the pump system 103 are explained.

Figure 7:
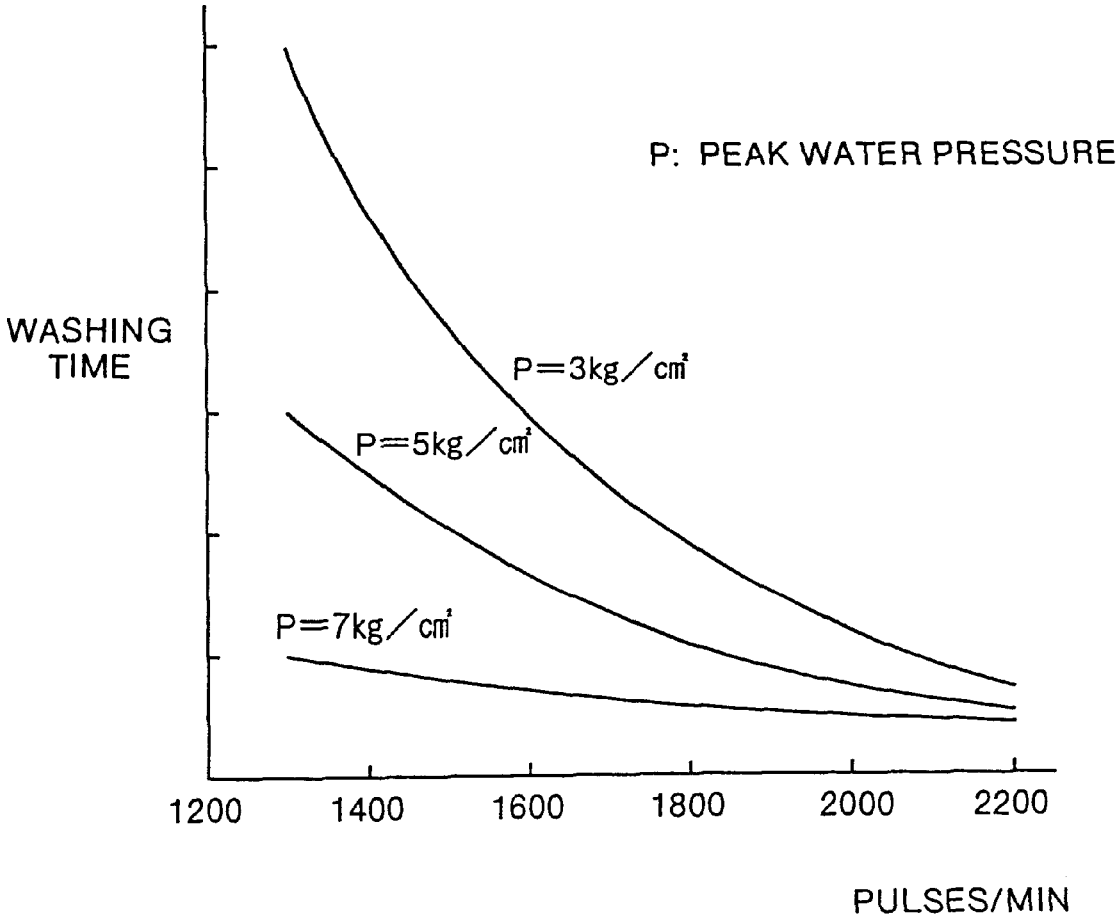
FIG. 7 is a graph showing the washing time of washing by varying the number of intermittent pulses in three types of peak water pressure in the head and face washing apparatus of embodiment 1.

FIG. 7 is a graph showing the washing time by washing by varying the number of intermittent pulses at three types of peak water pressure in the head and face washing apparatus of embodiment 1. At peak water pressure of P=7 kg/cm$^2$, the washing time does not depend so much on the number of pulses, but when the peak water pressure P is lowered, it is known that the washing time varies depending on the number of pulses. For example, at peak water pressure P=3 kg/cm$^2$, the tendency is prominent at the number of pulses of 1600 pulse per minute or less, and it is known that the washing power is lowered as the number of pulses per minute is decreased.

Figure 8:
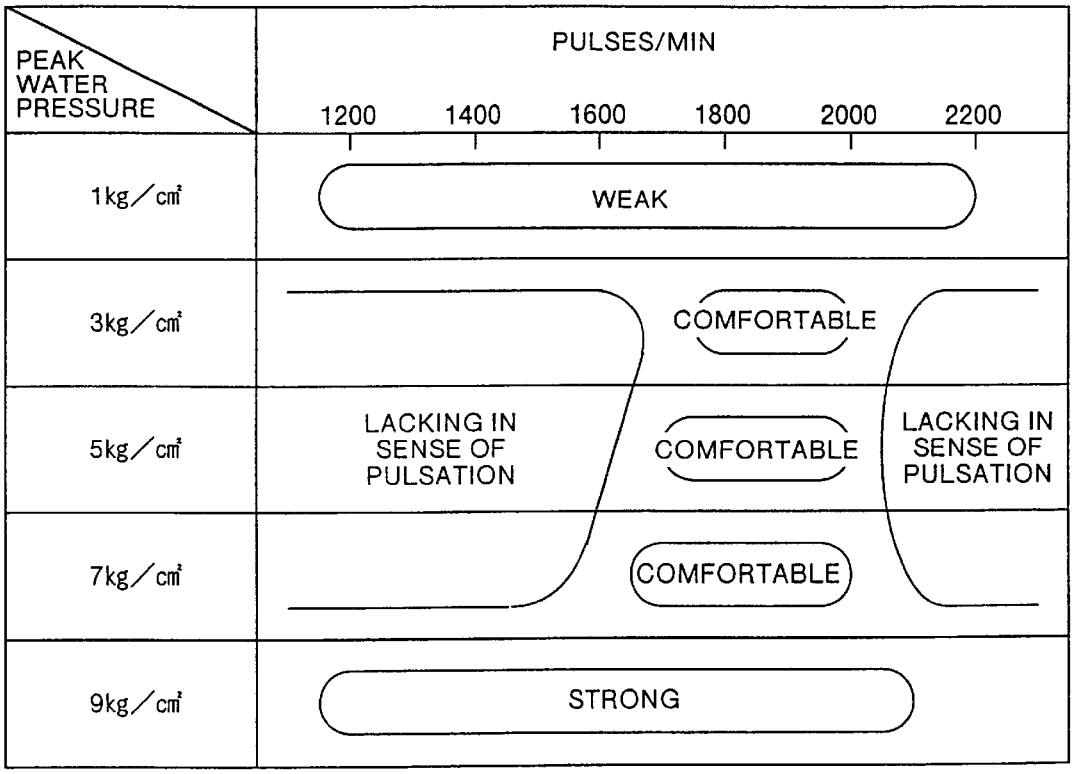
FIG. 8 is an explanatory diagram showing results of testing of feeling of use in the head and face washing apparatus of embodiment 1.

FIG. 8 is an explanatory diagram showing the result of test of actual feeling of use in the head and face washing apparatus of embodiment 1. As shown in FIG. 8, it is known that most users feel comfortable in the region of the number of pulses of 1600 to 2000 pulses per minute and the peak water pressure of 3 to 7 kg/cm$^2$.

It is therefore preferred to use the head and face washing apparatus of embodiment 1 in a range of the number of pulses of 1600 to 2000 pulses per minute and the peak water pressure of 3 to 7 kg/cm$^2$ for the sake of improvement of washing efficiency and massage effect. Hence, in the head and face washing apparatus of embodiment 1, it is designed to adjust the number of pulses and peak water pressure in this range. Adjustment of range can be realized by control of the pump system 103 by the drive controller 102, by input of user's instruction to the drive controller 102. Besides, depending on the number of pulses, the eject/stop interval shown in FIG. 4 to FIG. 6 varies.

Figure 9:
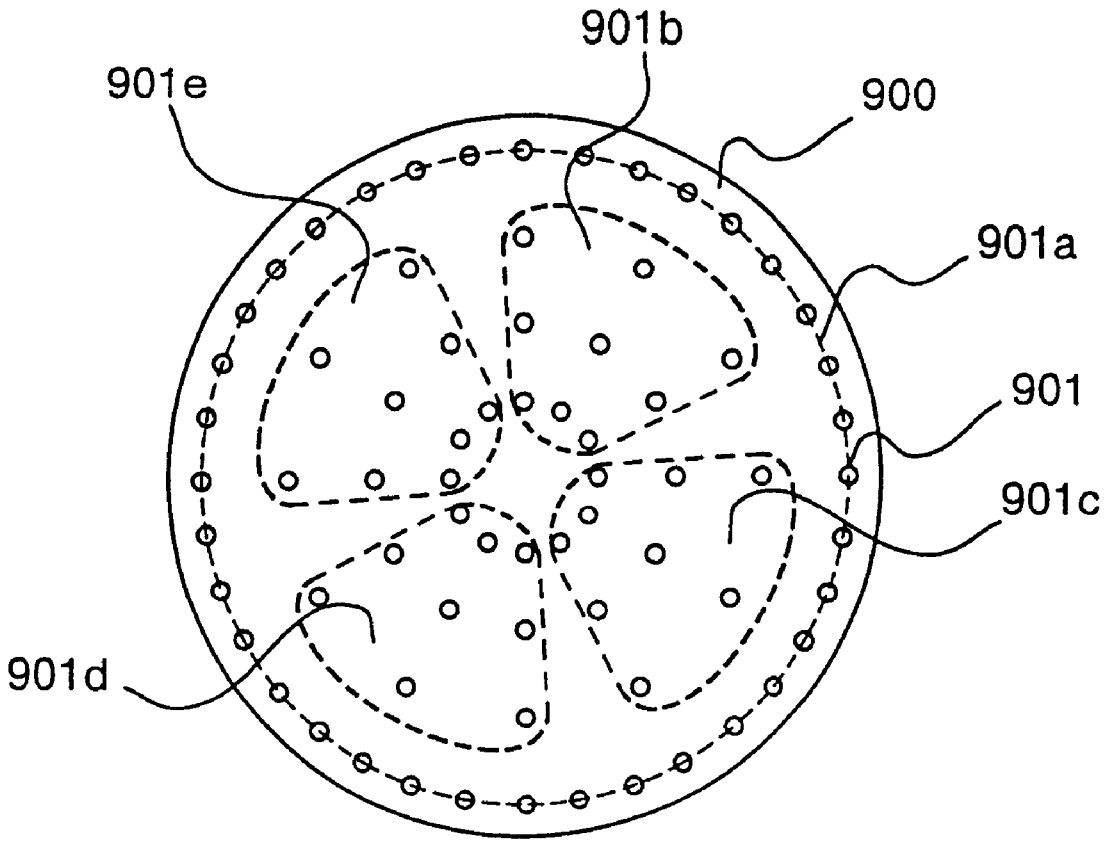
FIG. 9 is a plan showing other example of shower head in the head and face washing apparatus of embodiment.

FIG. 9 is a plan showing other example of shower head. Detailed description is omitted, but the shower head 120 shown in FIG. 9 is composed by radially forming supply blocks (indicated by dotted line) corresponding to the supply passages 106*a* to 106*d* shown in FIG. 3. In the shower head 120 shown in FIG. 9, spouts 121 are divided into groups in supply block units, and the ejection timing can be changed in each group same as in the timing charts shown in FIG. 4 to FIG. 6. Herein, reference numerals 121*a* to 121*e* show spout groups.

Figure 10:
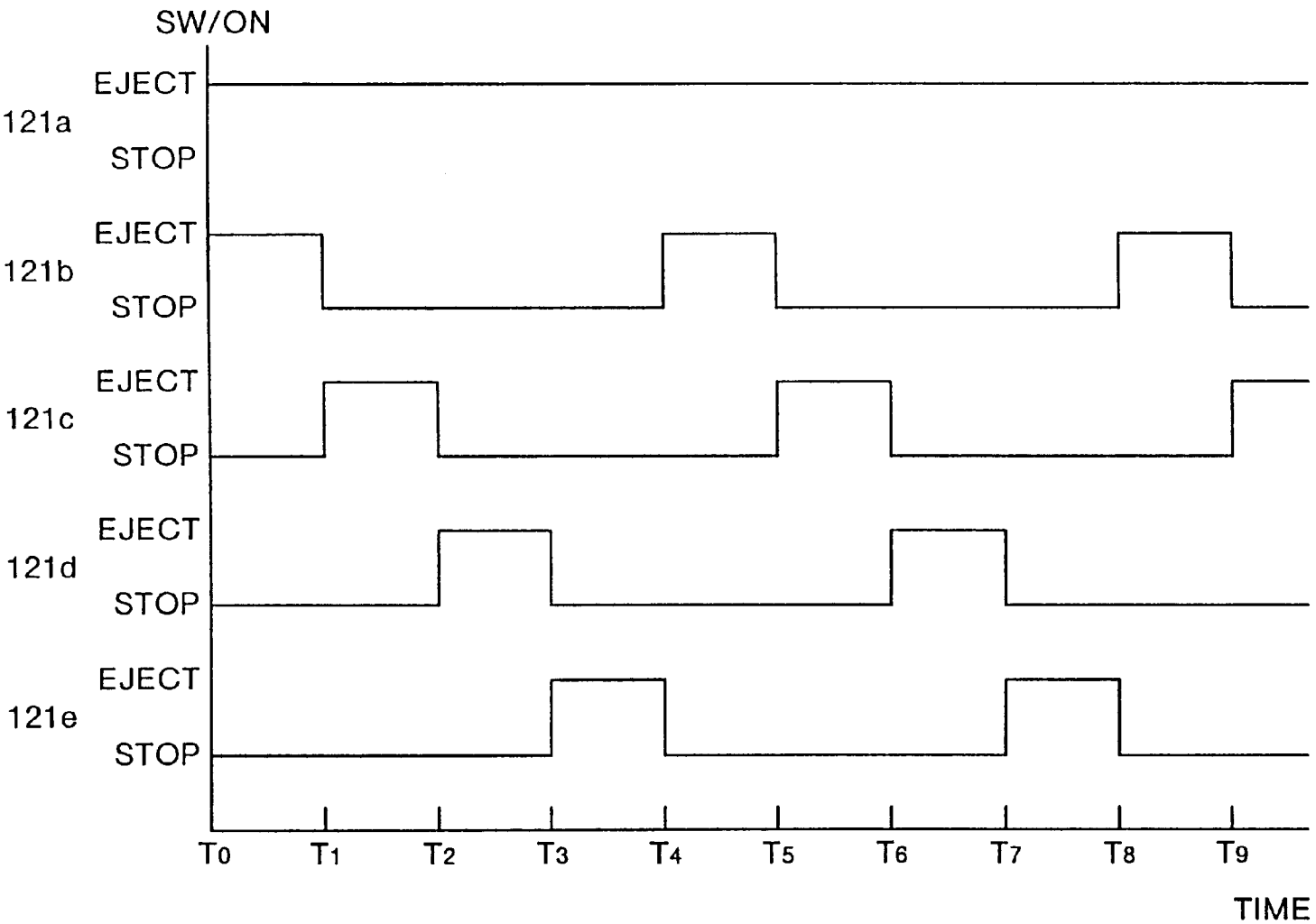
FIG. 10 is a timing chart showing an example of timing control of eject/stop in every spout group by using the shower head in FIG. 9 in the head and face washing apparatus of embodiment 1.

FIG. 10 is a timing chart showing an example of timing control of eject/stop in each spout group, when using the shower head 120 shown in FIG. 9. Detailed description is omitted, but in FIG. 10, continuous water stream is flowing out from the spout group 121*a*, and the ejecting positions are changed clockwise in the sequence of spout group 121*b*, spout group 121*c*, spout group 121*d*, and spout group 121*e*.

As clear from FIG. 9 and FIG. 10, by varying the spout positions, the massage feeling different from the case of using the shower head 104 shown in FIG. 2 can be presented to the user.

Thus, according to the head and face washing apparatus of embodiment 1, scattering of washing fluid is prevented by other method than the cover, and moreover the washing efficiency is improved, and the shower head is reduced in size and weight.

Further, the massage feeling is given to the user by changing the ejecting position and ejection timing, and hence a comfortable feeling is given to the user without loss of ejection pressure of washing fluid as experienced in the prior art.

The timing and water pressure for intermittent ejection of washing fluid can be adjusted in a range of the number of pulses of 1600 to 2000 pulses per minute and peak water pressure of 3 to 7 kg/cm$^2$, so that the washing efficiency and massage effect are further enhanced.

In embodiment 1, as shown in FIG. 2, the spouts 105 are divided in four groups, but only for the purpose of preventing bouncing by the water wall in the case of use of intermittent water stream of high washing efficiency, at least two spout groups may be formed at the outer circumference and the inside, and the intermittent water stream of high washing efficiency may be used by the inside group, and bouncing may be prevented by forming a water wall by the outer circumference group.

The spouts 105 of the outer circumference group may not be mere holes, but may be formed as slit spouts formed continuously or discontinuously along the circumference of the surface of the shower head 104 shown in FIG. 2, and the spout 105 corresponding to the inside spout group may be only one.

In embodiment 1, to prevent bouncing of water when using intermittent water stream, a continuous water stream is flowing out from the spout group 105*a* in the shower head 104 shown in FIG. 2. If, however, not necessary to consider bouncing of water intermittent water stream may be ejected from all spout groups. In this case, for example, as the pump 103*a* shown in FIG. 3, a pump capable of supplying intermittent water stream may be used. The drive controller 102 controls, including this pump 103*a*, the ejection timing of intermittent water stream as shown in FIG. 4 to FIG. 6. When using the shower head 120 shown in FIG. 9, similarly, intermittent water stream may be ejected from all spouts 121.

Moreover, as shown in FIG. 4 and FIG. 6, and FIG. 10, at least two spouts 105 may be enough if the massage feeling is given to the user by varying the ejecting position and ejection timing.

Not limited to the head and face, evidently, the head and face washing apparatus of embodiment 1 can be also applied in washing of other parts of the body.

Figure 11:
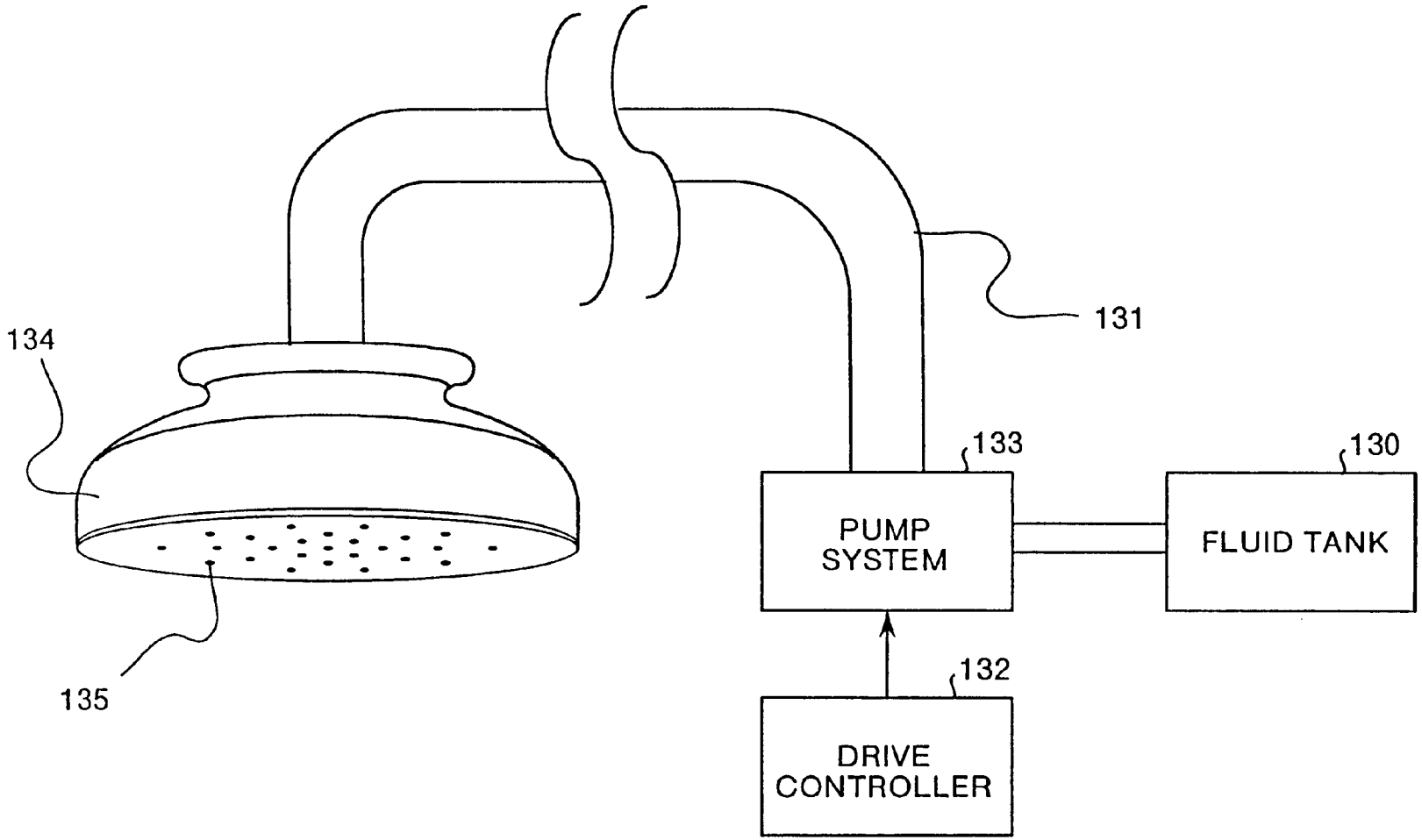
FIG. 11 is a schematic outline view of a head and face washing apparatus according to embodiment 2 of the invention.

FIG. 11 is a schematic view showing an outline structure of a head and face washing apparatus in embodiment 2. The head and face washing apparatus of embodiment 2 is intended to enhance the washing efficiency and massage effect by a simple structure, and comprises a fluid tank 130 for storing washing fluid (liquid), a pump system 133 for pumping the washing fluid supplied from the fluid tank 130 through a flexible supply pipe 131 under control of a drive controller 132, and a shower head 134 connected to the supply pipe 131 for ejecting the washing fluid supplied from the pump system 133 from a spout 135. Herein, instead of the fluid tank 130, a faucet may be connected to the pump system 133.

The fluid tank 130 and pump system 133 correspond to the fluid feed means of the invention, the supply pipe 131 corresponds to the fluid feed passage of the invention, the shower head 134 and spout 135 correspond to the fluid ejecting means of the invention, and the drive controller 132 corresponds to the fluid feed control means of the invention.

Figure 12:
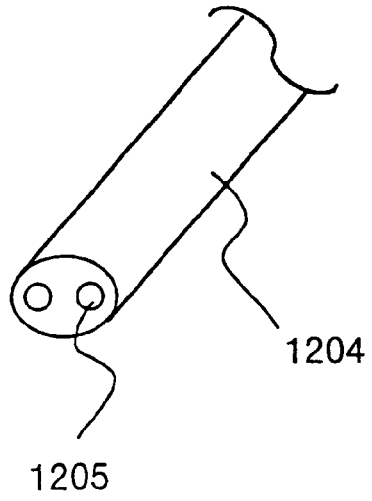
FIG. 12 is a schematic view showing other examples of shower heads in the head and face washing apparatus of embodiment 2, FIG. 12(*a*) being one example and FIG. 12(*b*) being another example.
Figure 12:
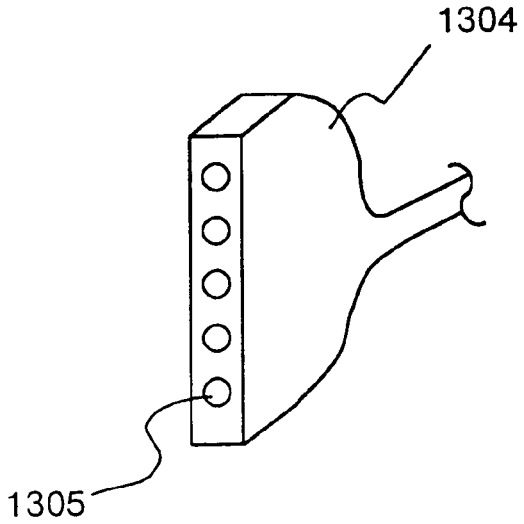

FIG. 12(*a*) and FIG. 12(*b*) are schematic diagrams showing other examples of the shower head 134 as fluid ejecting means. FIG. 12(*a*) shows shower head 144 and spout 145 as bar-form fluid ejecting means, and FIG. 12(*b*) shows shower head 154 and spout 155 as plate-form fluid ejecting means.

In the head and face washing apparatus of embodiment 2, intermittent water stream is used. To enhance the washing effect and massage effect, the peak water pressure of washing fluid when ejecting the washing fluid intermittently from the spout 135 of the shower head 134, and the reference number of pulses for ejecting the washing fluid intermittently by the pump system 133 are determined by the following experiment.

First, at three peak water pressures (3 kg/cm$^2$, 5 kg/cm$^2$, and 7 kg/cm$^2$), the washing time was measured by varying the number of intermittent pulses. The result was same as the graph in FIG. 7 explained in embodiment 1. That is, at peak water pressure of P=7 kg/cm$^2$, the washing time does not depend so much on the number of pulses, but when the peak water pressure P is lowered, it is known that the washing time varies depending on the number of pulses. For example, at peak water pressure P=3 kg/cm$^2$, the tendency is prominent at the number of pulses of 1600 pulse per minute or less, and it is known that the washing power is lowered as the number of pulses per minute is decreased.

Actual feeling of use was tested in the head and face washing apparatus of embodiment 2. The same result as shown in FIG. 8 was obtained. Specifically, it is known that most users feel comfortable in the region of the number of pulses of 1600 to 2000 pulses per minute and the peak water pressure of 3 to 7 kg/cm$^2$.

It is therefore preferred to use the head and face washing apparatus of embodiment 2 in a range of the number of pulses of 1600 to 2000 pulses per minute and the peak water pressure of 3 to 7 kg/cm$^2$ for the sake of improvement of washing efficiency and massage effect. Hence, in the head and face washing apparatus of embodiment 2, it is designed to adjust the number of pulses and peak water pressure in this range. In other words, by controlling the pump system 133 by the drive controller 132, the intermittent water stream of the number of pulses of 1600 to 2000 pulses per minute and the peak water pressure of 3 to 7 kg/cm$^2$ is ejected from the shower head 134.

The operation of the head and face washing apparatus of embodiment 2 is explained. Under the control of the drive controller 132, the pump system 133 intermittently pumps the washing fluid in the fluid tank 130 through the supply pipe 131. The pumped washing fluid gets into the shower head 134 from the supply pipe 131, and is ejected intermittently from the spout 135.

The user gives an instruction to the drive controller 132 in a range of the number of pulses of 1600 to 2000 pulses per minute and the peak water pressure of 3 to 7 kg/cm$^2$ and can adjust the number of pulses of intermittent water stream and peak water pressure according to the preference. The drive controller 132 controls the pump system 133 according to the number of pulses and peak water pressure instructed by the user, and the pump system 133 pumps out the intermittent water stream at the number of pulses and peak water pressure as designated by the user through the supply pipe 131 under the control of the drive controller 132.

As a result, the intermittent water stream felt preferable for the user is ejected from the spout 135 of the shower head 134.

Thus, according to the head and face washing apparatus of embodiment 2, it is possible to adjust the timing and water pressure for ejecting intermittently the washing fluid in a range of the number of pulses of 1600 to 2000 pulses per minute and the peak water pressure of 3 to 7 kg/cm$^2$, and therefore the washing efficiency and massage effect of the head and face washing apparatus can be enhanced in a simple structure.

Not limited to the head and face, evidently, the head and face washing apparatus of embodiment 2 can be also applied in washing of other parts of the body.

As embodiments 3 to 8 of the invention, examples of shower nozzle with hood of the invention are explained below.

Figure 13:
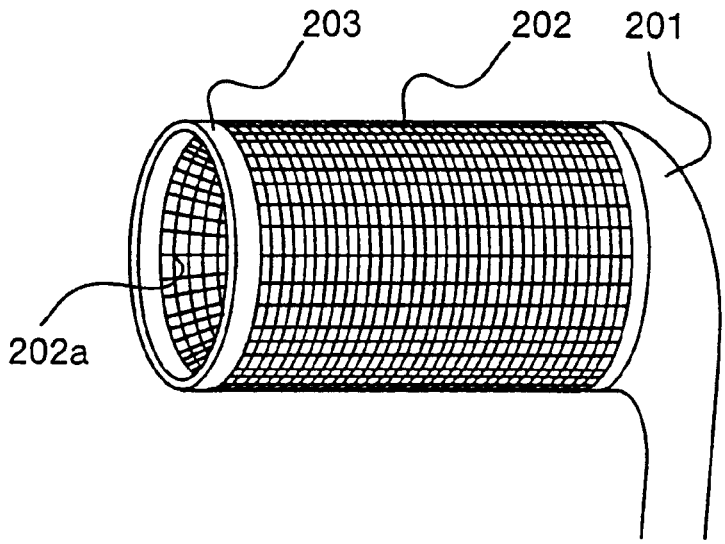
FIG. 13 is a structural diagram of a shower nozzle with hood according to embodiment 3 of the invention.
Figure 13:
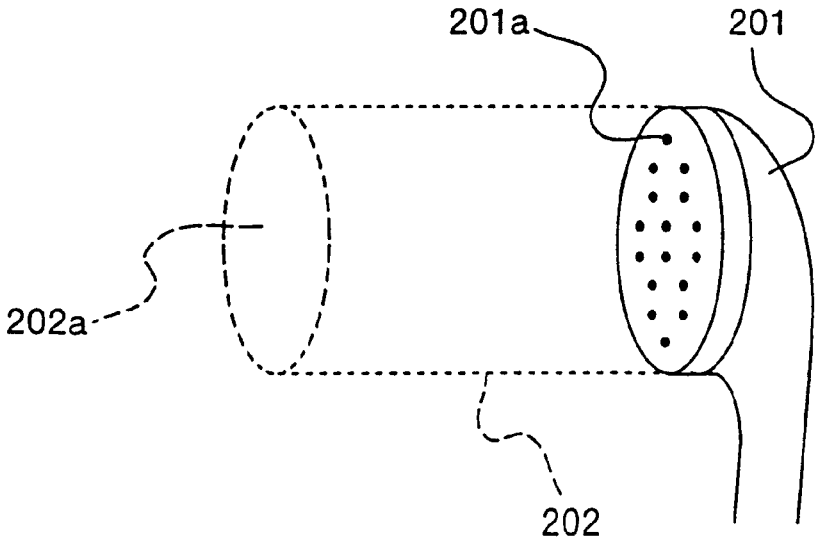

FIG. 13(*a*) and FIG. 13(*b*) show the structure of shower nozzle with hood according to embodiment 3, in which a cylindrical hood 202 for preventing scattering of water is provided so as to cover a discharge port 201*a* of a shower nozzle 201. The water scatter preventing hood 202 is made of a mesh material, and the mesh size may be rough (or fine) enough to prevent scattering of water, and, for example, a mesh material with mesh fibers of about 0.3 mm, knit at equal intervals of 1.0 mm between fibers, may be used.

The water scatter preventing hood 202 is rigid enough not to impede the water discharged from the discharge port 201*a* of the shower nozzle 201, and is designed to always keep a water passage from the discharge port 201*a* to an opening 202*a*.

At the opening 202*a* side of the water scatter preventing hood 202, a brim 203 is formed so as to prevent injury of the scalp and washing surface.

In this structure, when the head is washed by using the shower nozzle with hood of embodiment 3, the water discharged from the discharge port 201*a* of the shower nozzle 201 bounces back from the head and scatters, but it is shielded by the water scatter preventing hood 202, and falls by running along the water scatter preventing hood 202. The water discharged on the head and water drooping down along the water scatter preventing hood 202 may be easily discharged outside of the water scatter preventing hood 202 because the water scatter preventing hood 202 is made of mesh. Therefore, regardless of the discharge water pressure or discharge water flow from the shower nozzle 201, scattering of water is prevented, and water is discharged appropriately.

Figure 14:
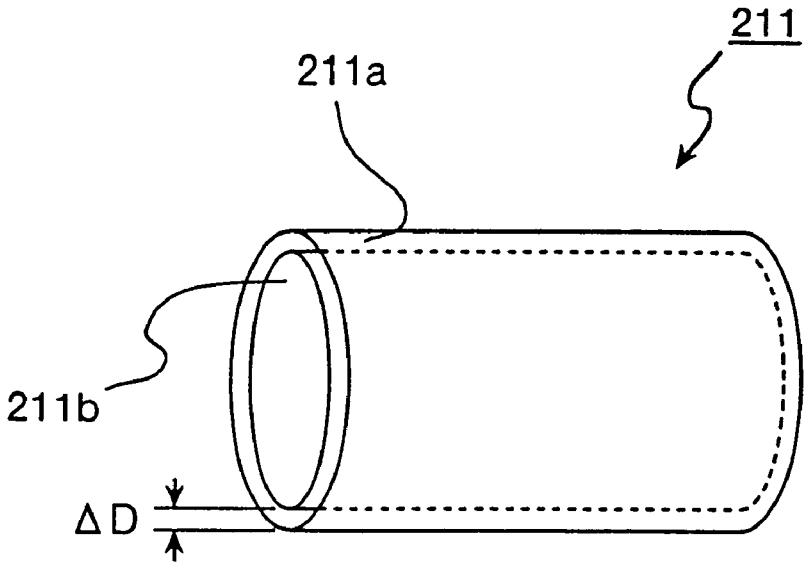
FIG. 14 is a structural diagram of a hood for preventing scattering of water according to embodiment 4 of the invention.

FIG. 14 shows a structure of water scatter preventing hood 211 of a shower nozzle with hood according to embodiment 4. Basically, it is same as embodiment 3, and only different points are explained below.

The water scatter preventing hood 211 is made of a mesh material laminated in multiple layers, with a space layer disposed between the layers, and as shown in the drawing, there is a space of ΔD between a mesh material 211*a* and a mesh material 211*b*.

In embodiment 4, too, the same effects are in embodiment 3 are obtained, and further since the water scatter preventing hood 211 is in a double structure and there is a space layer between the layers, so that the water scattering preventing effect may be further enhanced.

Figure 15:
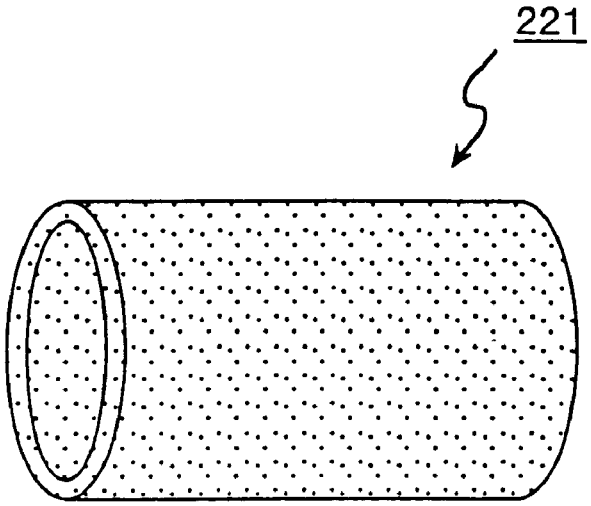
FIG. 15 is a structural diagram of a hood for preventing scattering of water according to embodiment 5 of the invention.

FIG. 15 shows a structure of water scatter preventing hood 221 of a shower nozzle with hood according to embodiment 5. The shower nozzle is same as in embodiment 3, and its illustration and description are omitted.

The water scatter preventing hood 221 is made of sponge (porous material), and any material may be used as far as excellent in water absorption and discharge, and, for example, HR-08 (cell range: about 8 cells in 25 mm interval), HR-13 (cell range: about 13 cells in 25 mm interval) and HR-20 (cell range: about 20 cells in 25 mm interval) of Ever-Light SP (Bridgestone) may be used.

The water scatter preventing hood 221 has a proper rigidity so as not to impede the water discharged from the discharge port of the shower nozzle, and is designed to keep passage for water always from the discharge port to the opening 202*a*.

Further, since the water scatter preventing hood 221 is made of sponge, it touches softly the scalp or washing surface, and does not injure the washing surface, while the water scattering preventing effect is high.

In this configuration, when the head is washed by using the shower nozzle with hood of embodiment 5, the water discharged from the discharge port of the shower nozzle bounces back from the head and scatters, but is shielded and absorbed by the water scatter preventing hood 221, and droops down along the water scatter preventing hood 221. Since the water scatter preventing hood 221 is made of sponge, water is easily discharged outside of the water scatter preventing hood 221. Therefore, regardless of the discharge water pressure and discharge water flow from the shower nozzle, scattering of water can be prevented, and water is discharged appropriately.

Figure 16:
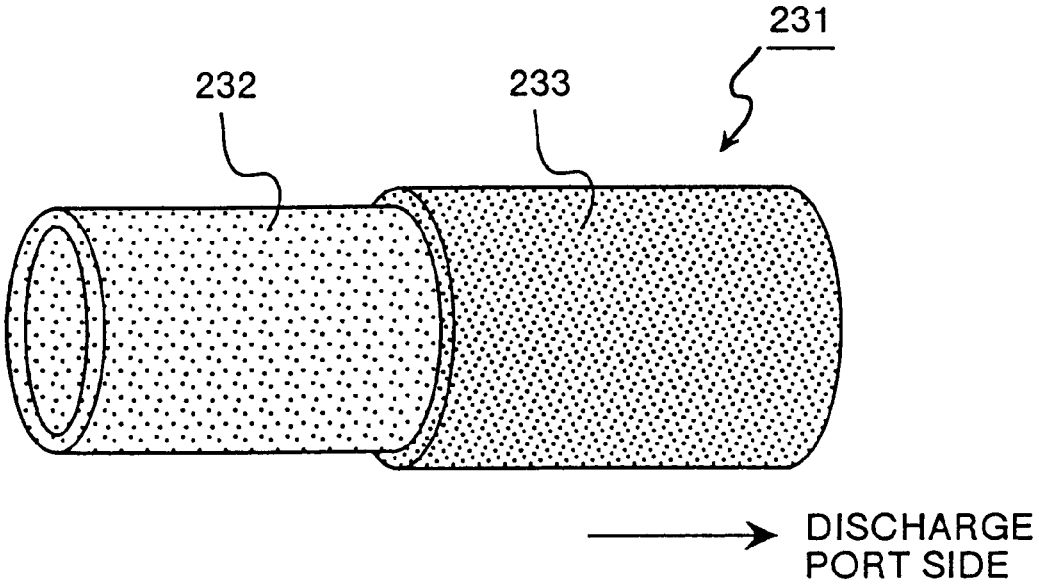
FIG. 16 is a structural diagram of a hood for preventing scattering of water according to embodiment 6 of the invention.

FIG. 16 shows a structure of water scatter preventing hood 231 of a shower nozzle with hood according to embodiment 6. The shower nozzle is same as in embodiment 3, and its illustration and description are omitted.

The water scatter preventing hood 231 of embodiment 6 is composed of a first hood 232 made of a soft sponge (porous material), and a second hood 233 made of a stiff sponge (porous material), and the discharge port side of the first hood 232 is covered with the second hood 233 as shown in the drawing.

In embodiment 6, too, the same effects as in embodiment 5 are obtained, and moreover since the water scatter preventing hood 231 is in a double structure, and the second hood 233 made of stiff sponge (porous material) is at the discharge port side, and this second hood 233 can be held during washing operation, so that the working efficiency is enhanced. Besides, since a proper rigidity is held by the second hood 233, a softer sponge excellent in water absorbing and discharging function may be used in the first hood 232, so that the feeling of use maybe enhanced.

Figure 17:
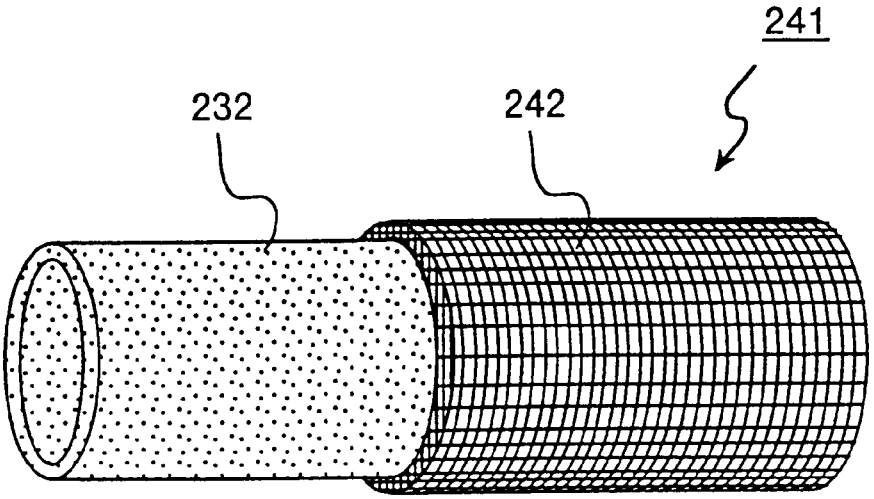
FIG. 17 is a structural diagram of a hood for preventing scattering of water according to embodiment 7 of the invention.

FIG. 17 shows a structure of water scatter preventing hood 241 of a shower nozzle with hood according to embodiment 7. The shower nozzle is same as in embodiment 3, and its illustration and description are omitted.

The water scatter preventing hood 241 of embodiment 7 is similar to the water scatter preventing hood 231 of embodiment 6 shown in FIG. 16, except that the second hood 233 is changed to a second hood 242 made of a mesh material. Since the second hood 242 is made of a mesh material, by keeping a proper rigidity with this mesh material, the washing operation can be done by holding this second hood 242, and the working efficiency is enhanced.

Figure 18:
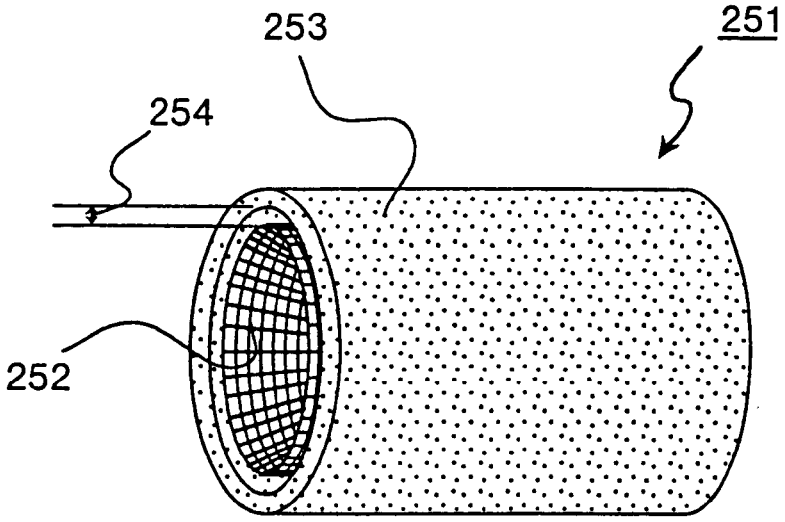
FIG. 18 is a structural diagram of a hood for preventing scattering of water according to embodiment 8 of the invention.

FIG. 18 shows a structure of water scatter preventing hood 251 of a shower nozzle with hood according to embodiment 8. The shower nozzle is same as in embodiment 3, and its illustration and description are omitted.

The water scatter preventing hood 251 of embodiment 8 is composed of a first hood 252 made of a mesh material, and a second hood 253 made of sponge (porous material), and a space layer 254 is provided between the first hood 252 and second hood 253.

In the water scatter preventing hood 251 of embodiment 8, in addition to the effects of embodiment 3, since the mesh material and porous material are combined, if a soft porous material is used, by making use of the tenacity of the mesh material, it is possible to avoid clogging of the discharge port of the nozzle due to excessive inside bending of the porous material.

Figure 19:
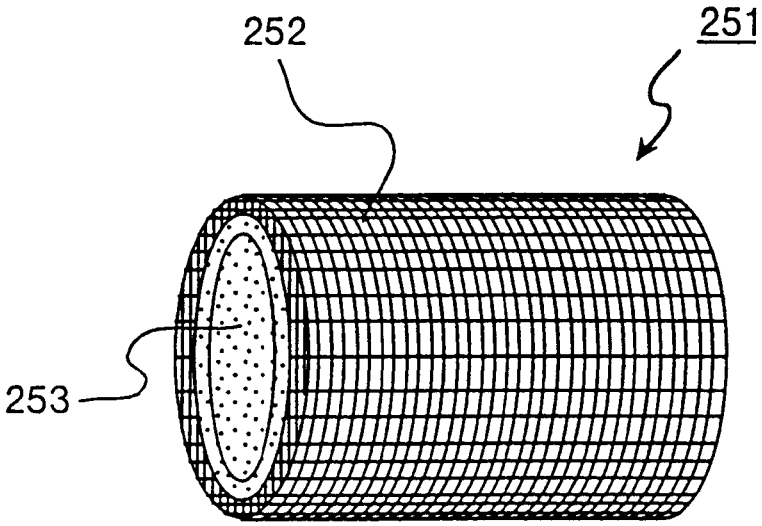
FIG. 19 is an explanatory diagram showing a modified example of embodiment 8.

In embodiment 8, the first hood 252 made of mesh material is disposed at the inner side, but as shown in FIG. 19, the second hood 253 may be disposed at the inner side and the first hood 252 may be disposed at the outer side.

Figure 20:
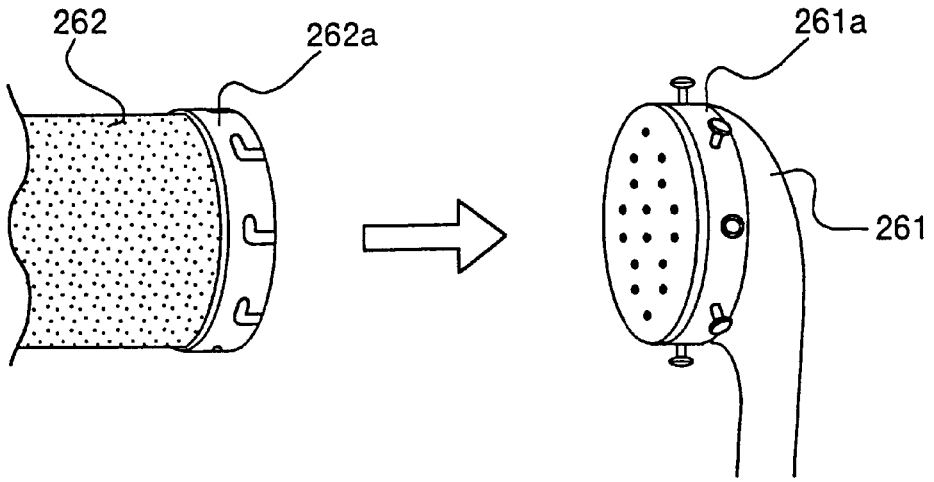
FIG. 20 is an explanatory diagram showing modified examples of embodiments 3 to 8.
Figure 21:
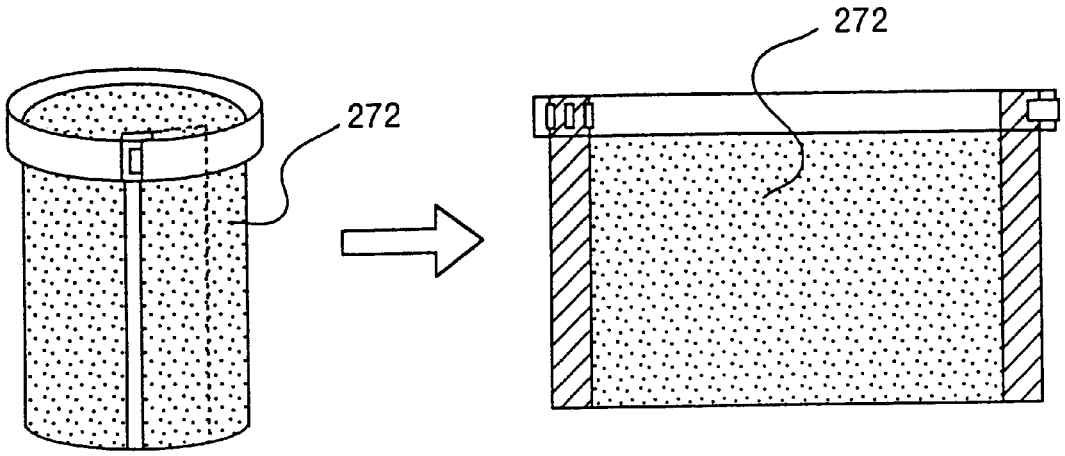
FIG. 21 is an explanatory diagram showing modified examples of embodiments 3 to 8.

As a modified example of the foregoing embodiments 3 to 8, as shown in FIG. 20, for example, a detachable structure may be set up by providing a shower nozzle 261 and a water scatter preventing hood 262 with detaching mechanisms 261*a* and 262*a*, respectively. In such constitution, plural water scatter preventing hoods 262 may be prepared and used by exchange, and the standby water scatter preventing hood 262 may be dried and disinfected, and it is very hygienic. In particular, mold and malodor can be prevented, and the feeling of use is improved. Moreover, as shown in FIG. 21, it is more effective to compose a structure for opening and drying a cylindrical water scatter preventing hood 272.

Figure 22:
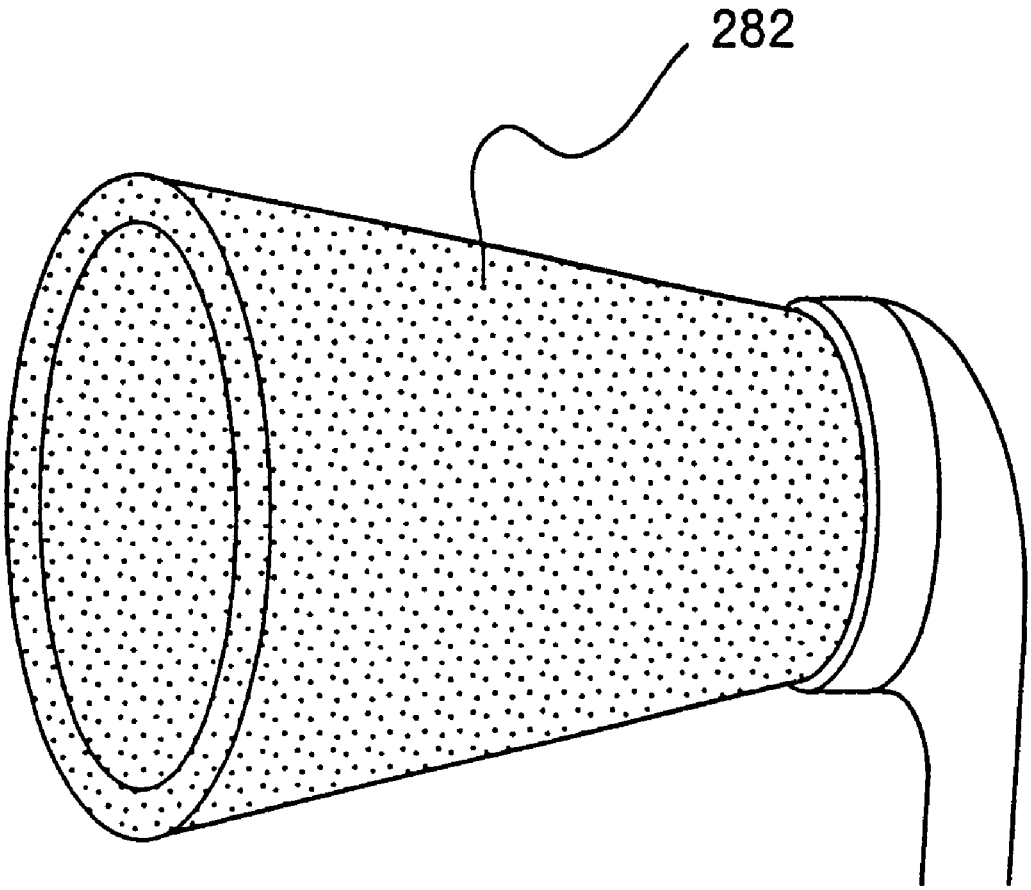
FIG. 22 is an explanatory diagram showing modified examples of embodiments 3 to 8.

Further, as shown in FIG. 22, a water scatter preventing hood 282 may be formed in a cylindrical shape gradually increasing in inside diameter from the discharge port side of the shower nozzle to the washing area side. As a result, if the hood is kept in contact with the washing surface, the water hitting area can be varied, and the washing effect and working efficiency may be enhanced.

As embodiments 9 to 13 of the invention, examples of comb type scalp washing tool of the invention are explained below.

Figure 23:
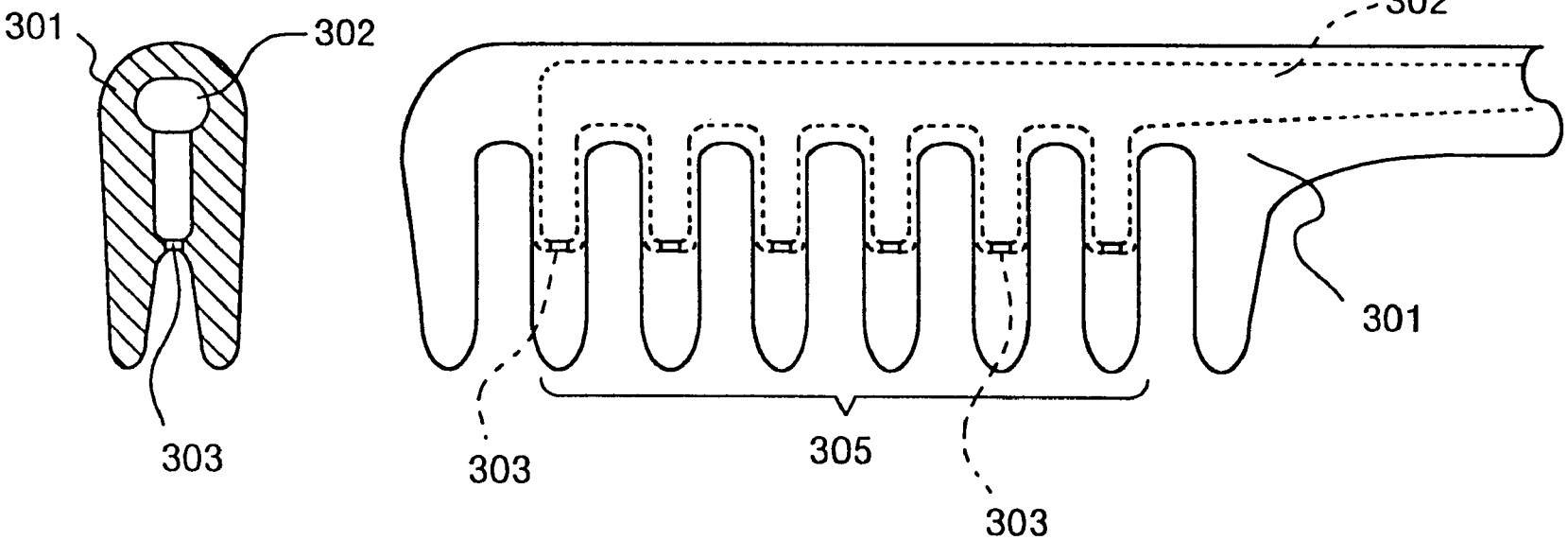
FIG. 23 is an explanatory diagram showing a configuration of the main body according to embodiment 9 of the invention.
Figure 24:
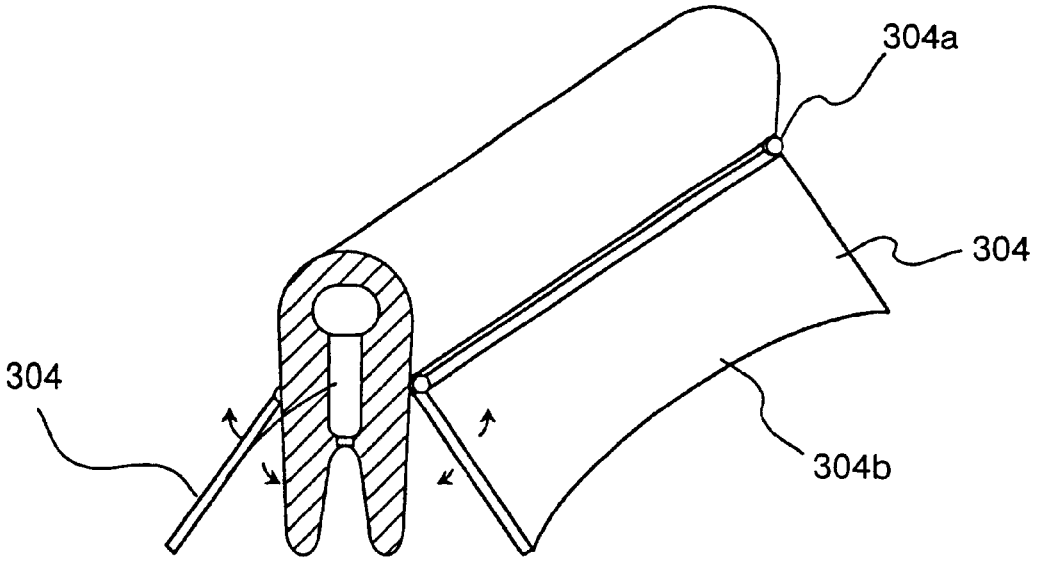
FIG. 24 is an explanatory diagram showing a configuration of the cover of embodiment 9.

FIG. 23 and FIG. 24 are explanatory diagrams showing a schematic structure of comb type scalp washing tool of embodiment 9, and FIG. 23 shows the structure of a comb main body 301, and FIG. 24 is an explanatory diagram showing the structure of a cover of embodiment 9.

The comb type scalp washing tool of embodiment 9 is designed to discharge the liquid supplied through a fluid feed passage 302 in the comb main body 301 through plural discharge ports 303 provided in the comb teeth. The comb main body 301 is provided with a cover 304 as shown in FIG. 24.

This cover 304 is disposed to enclose at least the plural discharge ports 303 at a position before and after in the comb moving direction, and is variable in height in the vertical direction to the scalp so as to follow up the head surface. Specifically, the cover 304 is composed of two transparent acrylic pieces, and is disposed in a V-form with one point of the cover 304 as a fulcrum 304*a*, enclosing the comb main body 301, and it is designed to vary the height in the vertical direction to the scalp surface with the fulcrum 304*a* as axis of rotation. The contact surface 304*b* the head is round, and it is easy to work, and easy to follow up the head surface.

The cover 304 has a width 305 (see FIG. 23) for covering at least the plural discharge ports 303 for preventing the washing fluid discharged from the discharge ports 303 from scattering about.

In this constitution, the comb type scalp washing tool wit the cover 304 is brought into contact with the head, and while the fluid supplied through the fluid feed passage 302 in the comb main body 301 is being discharged through the plural discharge ports 303 provided in the comb teeth, the hair is combed and washed, and the cover 304 is rotated easily about the fulcrum 304*a* and follows up the motion of the comb main body 301, thereby preventing scattering of the fluid discharged from the discharge ports 303. Besides, since the cover 304 is made of a transparent acrylic material, the inside of the cover 304 (that is, the comb tooth area) is visible and it is easy to work.

In other words, the comb type scalp washing tool of embodiment 9 can prevent scattering of fluid which may disturb the motion of the comb.

In embodiment 9, the cover 304 is made of two pieces, but, for example, each cover 304 maybe formed of plural short cut pieces, so as to follow up fine uneven surface more easily.

Figure 25:
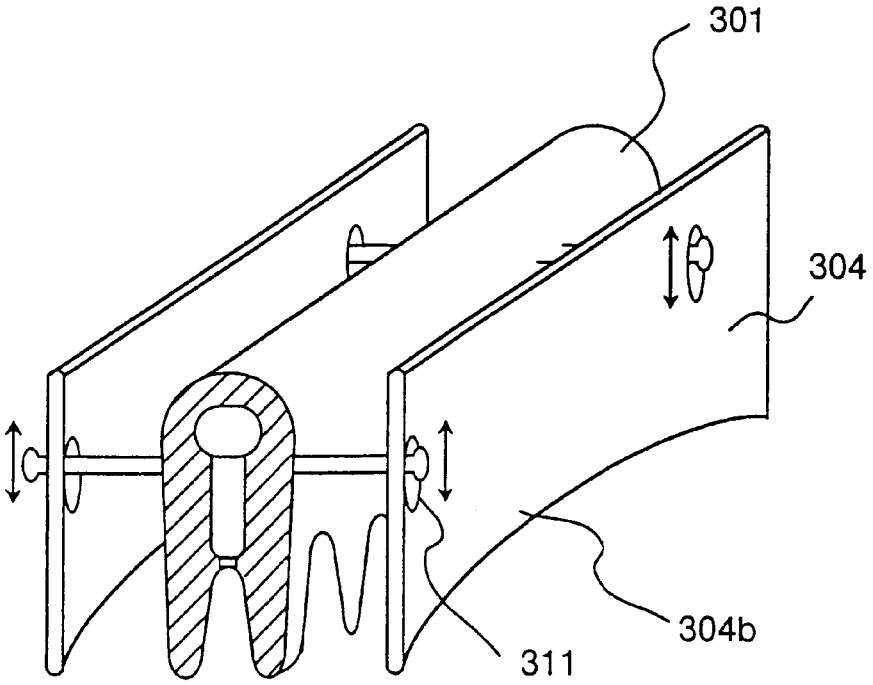
FIG. 25 is an explanatory diagram showing a configuration of a cover according to embodiment 10 of the invention.

FIG. 25 shows a structure of a cover 304 of a comb type scalp washing tool of embodiment 10. The other structure is same as in embodiment 9, and the illustration and explanation are omitted.

The comb type scalp washing tool in embodiment 10 is composed by fitting two covers 304 to enclose the comb main body 301 parallel. At this time, the interval of the comb main body 301 and the cover 304 is, for example, about 5 to 10 mm. The cover 304 has a slit 311 as shown in the drawing, and it is designed to be variable in height in the vertical direction by means of this slit 311.

In this configuration, the comb type scalp washing tool of embodiment 10 also as the same effects as that of embodiment 9.

Figure 26:
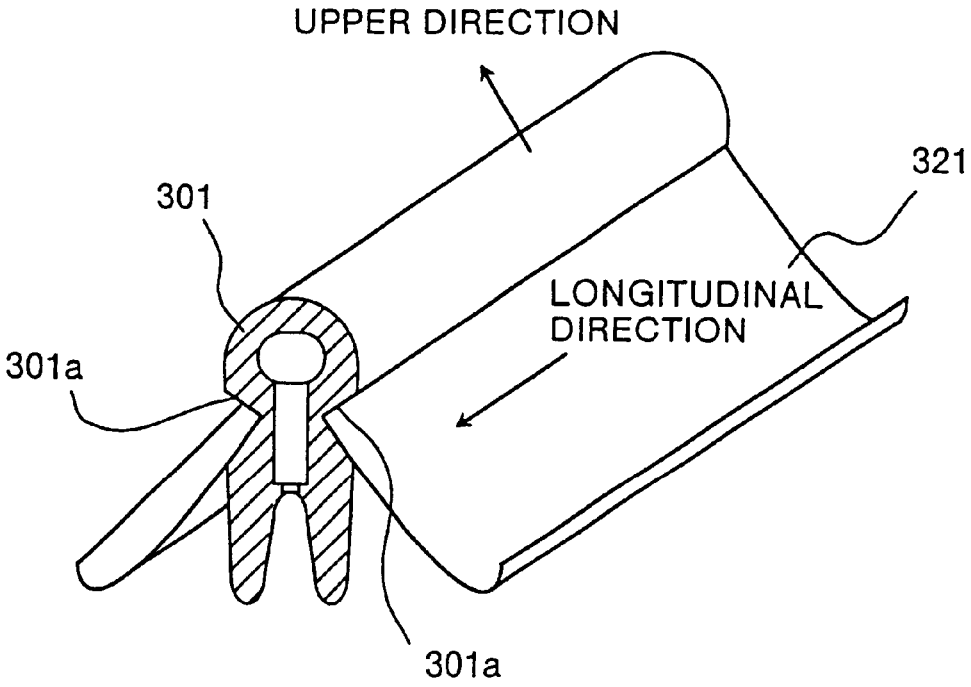
FIG. 26 is an explanatory diagram showing a configuration of a cover according to embodiment 11 of the invention.

FIG. 26 shows a structure of a cover 321 of a comb type scalp washing tool of embodiment 11. The basic structure is same as in embodiment 9, and only different points are explained below.

The cover 321 in embodiment 11 is provided so as to be detachable from the comb main body 301. Herein, the cover 321 is one cover having adequate rigidity and flexibility, and is designed to hold the comb main body 301 at a position of a groove 301*a* provided in the comb main body 301. When this cover 321 is pulled out in the longitudinal direction or upward direction as shown in the drawing, it can be easily detached from the comb main body 301.

Therefore, the comb teeth of the comb main body 301 and the cover 321 can cleaned easily. Or when the cover is made of an inexpensive material, the cover may be disposable.

Figure 27:
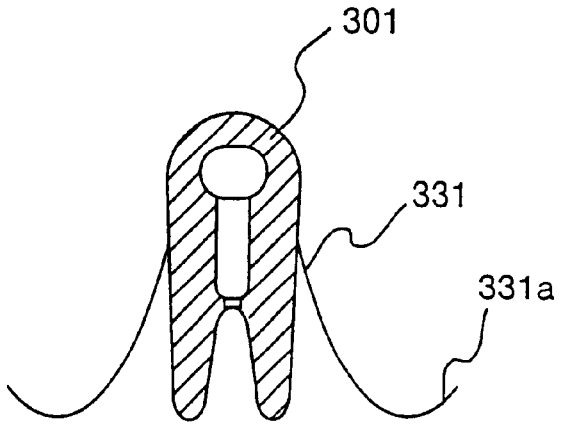
FIG. 27 is an explanatory diagram showing a configuration of a cover according to embodiment 12 of the invention.

FIG. 27 shows a structure of a cover 331 of a comb type scalp washing tool of embodiment 12. The basic structure is same as in embodiment 9, and only different points are explained below.

The cover 331 in embodiment 12 is made of a soft transparent plastic film, and is adhered to the comb main body 301, with at least the discharge port of washing fluid covering a certain width. The cover 331 is wider at the end so as not to be rolled into the comb main body 301 side, and the film leading end 331*a* is curled so as not to escape and project over the hair.

According to embodiment 12, in addition to the effects of embodiment 9, since the cover 331 is made of a plastic film, the cover can be manufactured easily, at light weight and low cost. Similarly, to manufacture the cover easily, at light weight and low cost, the cover may be made of cloth, mesh, rubber, or vinyl. In such a case, however, in order not to be rolled into the leading end of the comb teeth (comb main body 301), the length of the cover must be slightly shorter than the leading end of the comb.

Figure 28:
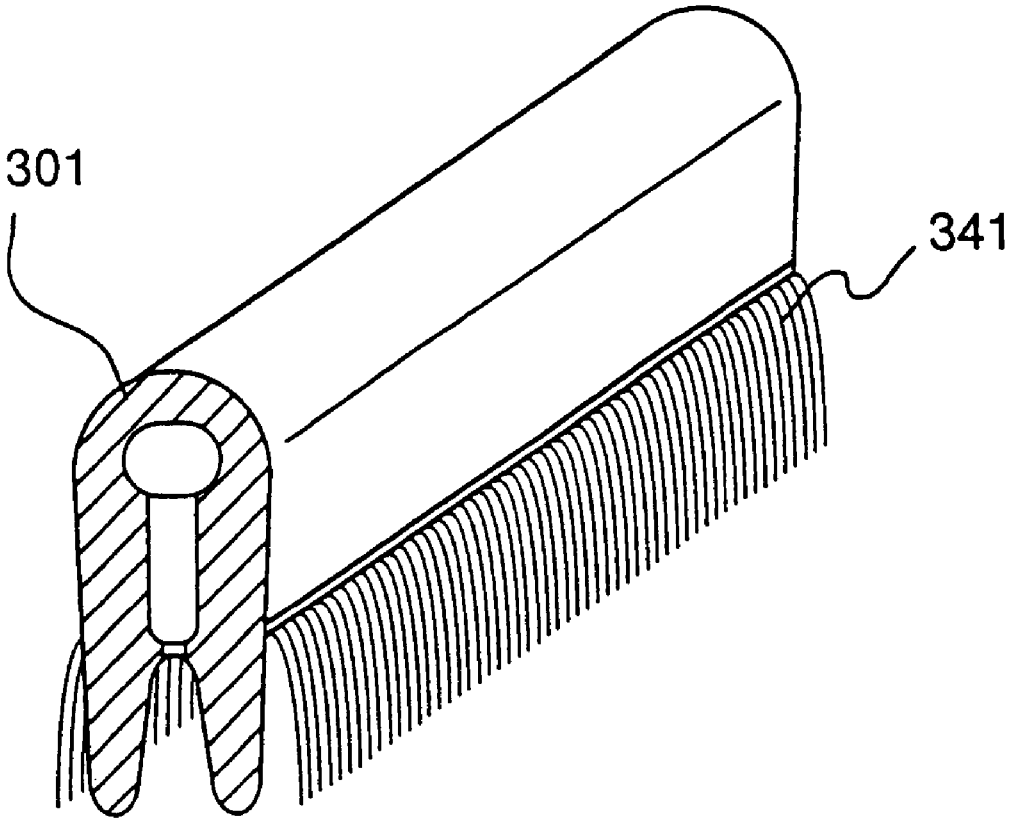
FIG. 28 is an explanatory diagram showing a configuration of a cover according to embodiment 13 of the invention.

FIG. 28 shows a structure of a cover 341 of a comb type scalp washing tool of embodiment 13. The basic structure is same as in embodiment 9, and only different points are explained below.

The cover 341 in embodiment 13 is formed like a brush. Accordingly, as compared with the film-form cover, it is easier to follow up undulations in the longitudinal direction or small asperities, and it is small in size and soft in touch. That is, without disturbing the motion of the comb, scattering of fluid can be prevented, and the touch of use is soft at the same time.

As embodiments 14 to 16 of the invention, examples of head washing shower brush of the invention are described below.

Figure 29:
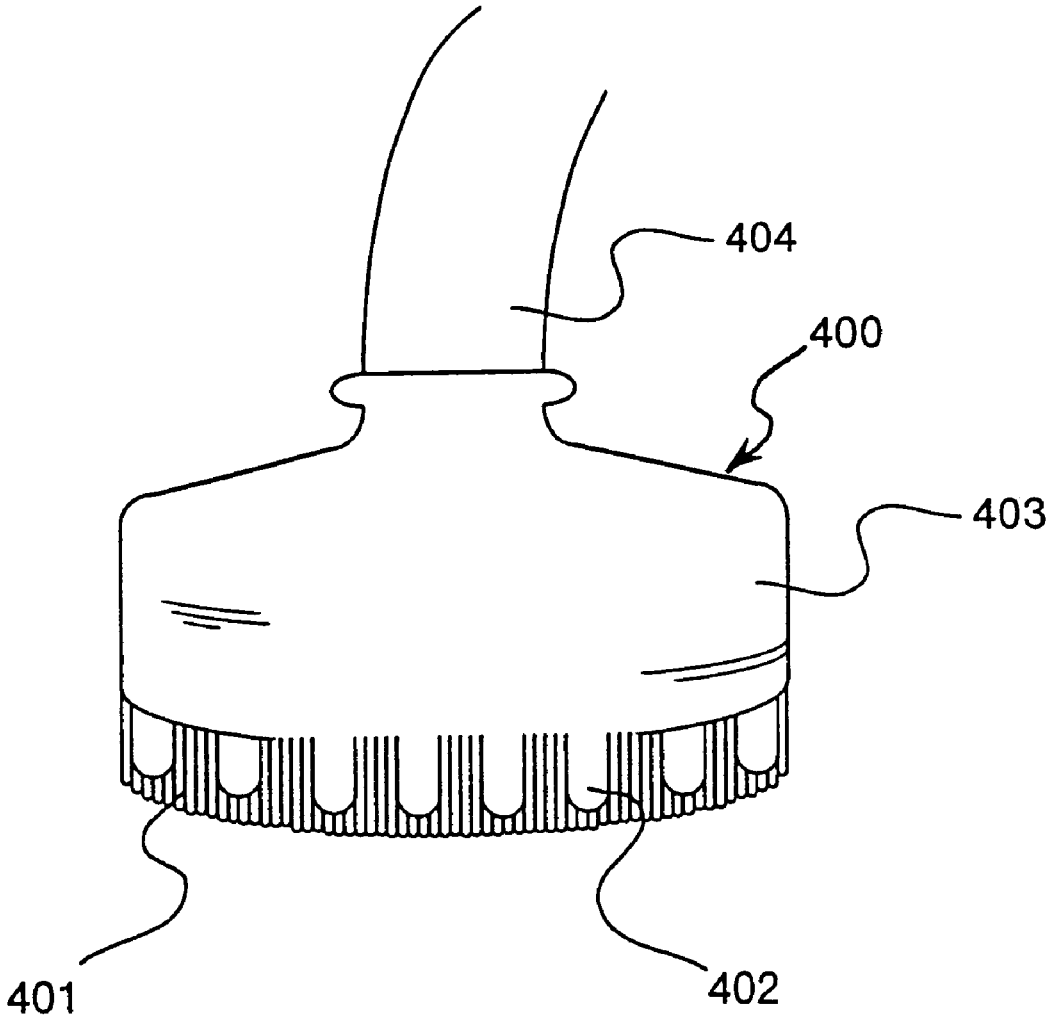
FIG. 29 is a perspective view of a head washing of shower brush according to embodiment 14 of the invention.
Figure 30:
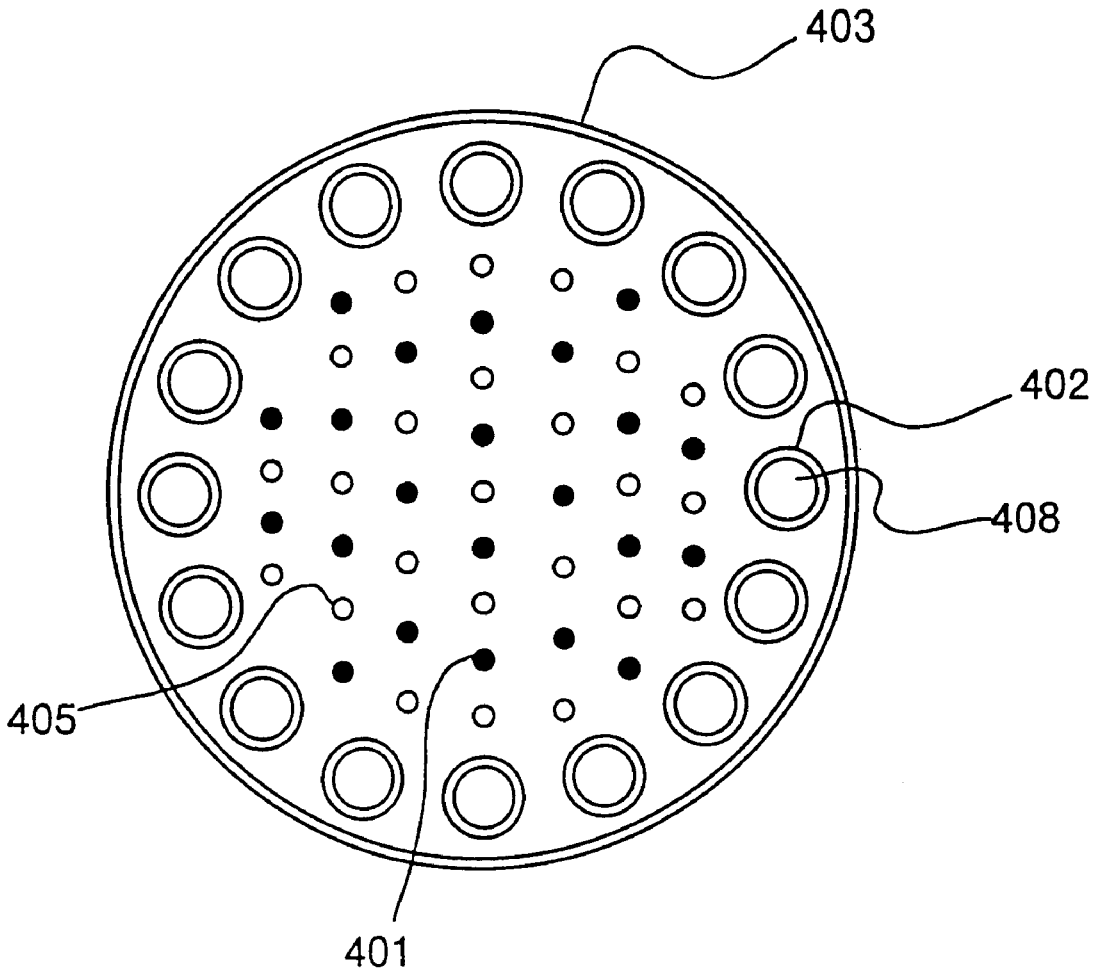
FIG. 30 is a bottom view of the head washing shower brush of embodiment 14.
Figure 31:
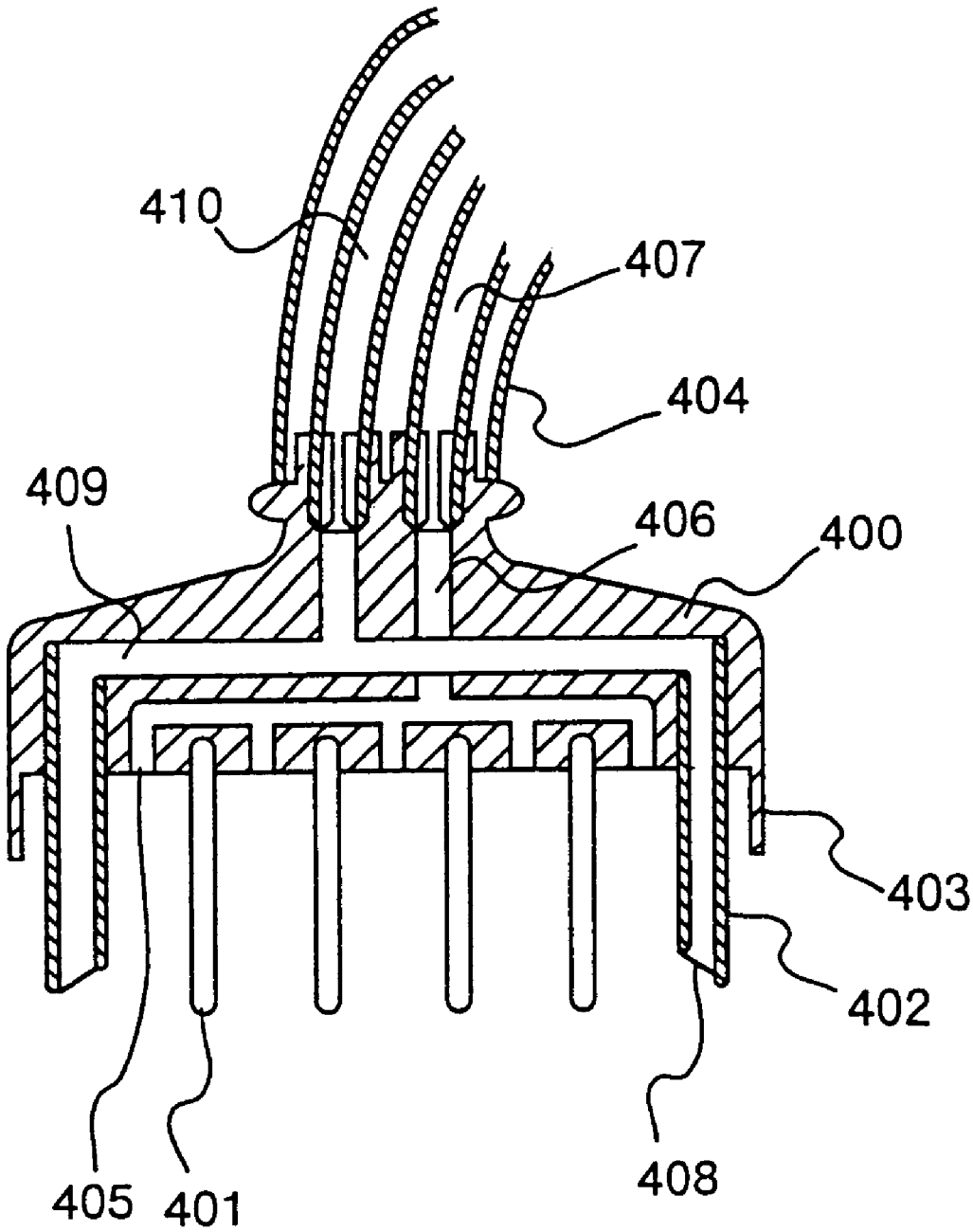
FIG. 31 is a sectional view of the head washing shower brush of embodiment 14.

FIG. 29 to FIG. 31 show a head washing shower brush according to embodiment 14, and FIG. 29 is a perspective view, FIG. 30 is a bottom view, and FIG. 31 is a sectional view. In the drawings, reference numeral 401 denotes comb teeth formed on a brush base 400, 402 is a flexible tube having a suction port 408, 403 is a cover formed integrally with the brush base 400, 404 is a hose having a supply pipe 407 for supplying fluid into the head washing shower brush from outside, and a suction pipe 410 for sucking the fluid from outside, 405 is a spout for ejecting the fluid supplied from the supply pipe 407 through a supply passage 406, and 409 is a suction passage for connecting the suction pipe 410 and flexible tube 402.

The operation of the head washing shower brush having such structure is explained. First, using a pump and others, supply and suction of fluid such as shampoo are started, and the head washing shower brush is fitted to the head for brushing. The supplied fluid is fed as an intermittent water stream of high washing efficiency.

The supplied fluid is ejected toward the head from the spout 405 by way of the supply pipe 407 and supply passage 406. On the other hand, the fluid ejected toward the head is sucked from the suction port 408 of the flexible tube 402, and is discharged outside through the inside of the flexible tube 402, suction passage 409 and suction pipe 410. It is hence possible to wash and rinse while brushing.

The flexible tube 402 does not interfere brushing, even while brushing, because of its flexibility. If there is unevenness due to hair, it follows up the unevenness, and hence does not interfere brushing, and the fluid can be sucked securely. Moreover, since the flexible tube 402 is provided on the outer circumference of the head washing shower brush so as to surround the comb teeth 401, the fluid ejected from the spout 405 is easily collected, and is not allowed to escape outside of the head washing shower brush. In FIG. 29 and FIG. 31, the flexible tube 402 is shown shorter than the comb teeth 401, but when the flexible tube 402 is formed longer than the comb teeth 401, the contact with the scalp is reinforced, and the fluid can be sucked more securely.

Besides, as clear from FIG. 31, the suction port 408 of the flexible tube 402 is cut off in the leading end portion so as to be directed inside, that is, to the comb teeth 401 side. By thus cutting off the leading end portion of the flexible tube 402, the fluid ejected from the spout 405 is prevented from escaping outside.

The cover 403 serves to prevent the fluid scattering high from popping outside.

Thus, according to the head washing shower brush of embodiment 14,by applying the fluid directly on the head, it is possible to wash and rinse while brushing. By sucking the fluid while applying the fluid directly on the head, scattering of fluid is prevented, and the fluid is prevented from leaking outside.

Figure 32:
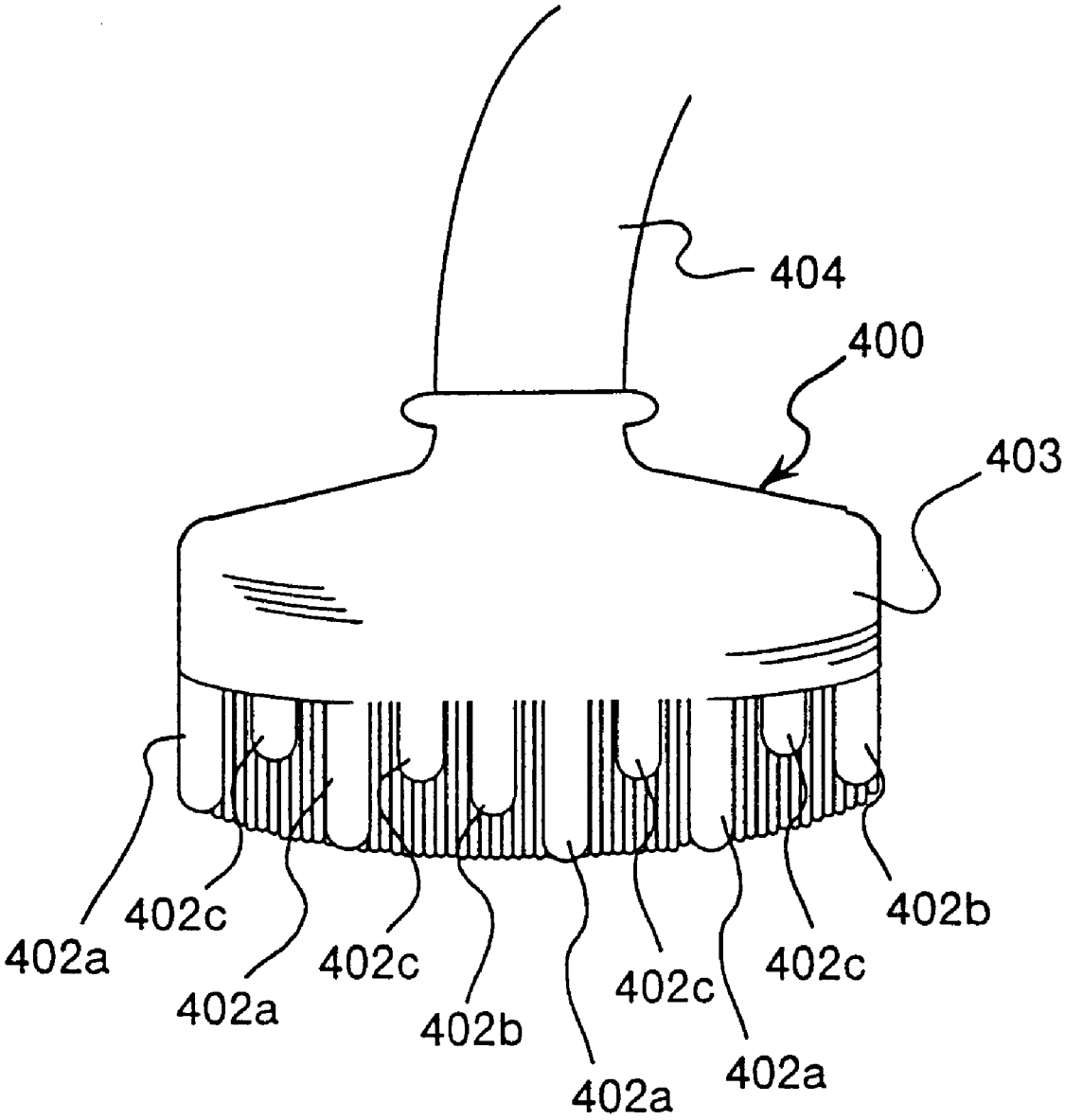
FIG. 32 is a perspective view of a head washing shower brush according to embodiment 15 of the invention.
Figure 33:
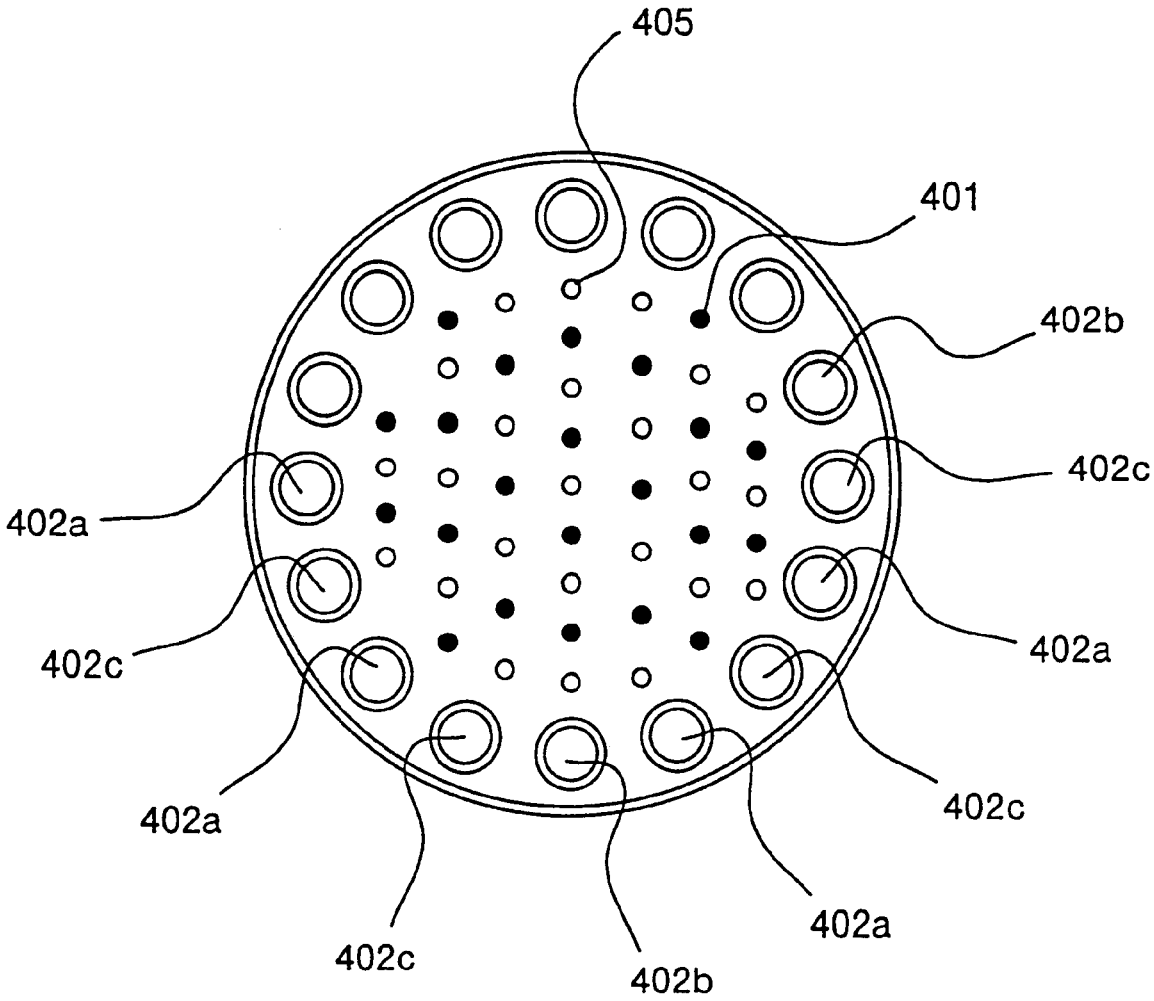
FIG. 33 is a bottom view of the head washing shower brush of embodiment 15.

FIG. 32 and FIG. 33 show a head washing shower brush according to embodiment 15, and FIG. 32 is a perspective view and FIG. 33 is a bottom view. In FIG. 32 and FIG. 33, same pats as in FIG. 29 to FIG. 31 are identified with same reference numerals and explanations are omitted, and only different points are explained herein.

What the head washing shower brush in embodiment 15 differs from embodiment 14lies in the different lengths of the flexible tubes 402. In FIG. 32 and FIG. 33, reference numeral 402*a* is a long flexible tube, 402*b* is a medium flexible tube, and 402*c* is a short flexible tube. FIG. 33 shows only the flexible tube 402 expressed in FIG. 32 by distinguishing with reference numerals 402*a* for long flexible tube, 402*b* for medium flexible tube, and 402*c* for short flexible tube.

When using shampoo or the like as the fluid, brushing causes foams and the comb teeth 401 may be filled with foams. By using the head washing shower brush of embodiment 15, the upper foams are sucked effectively by the short flexible tube 402*c*, middle foams by the medium flexible tube 402*b*, and lower foams (on the head) by the long flexible tube 402*a*.

Figure 34:
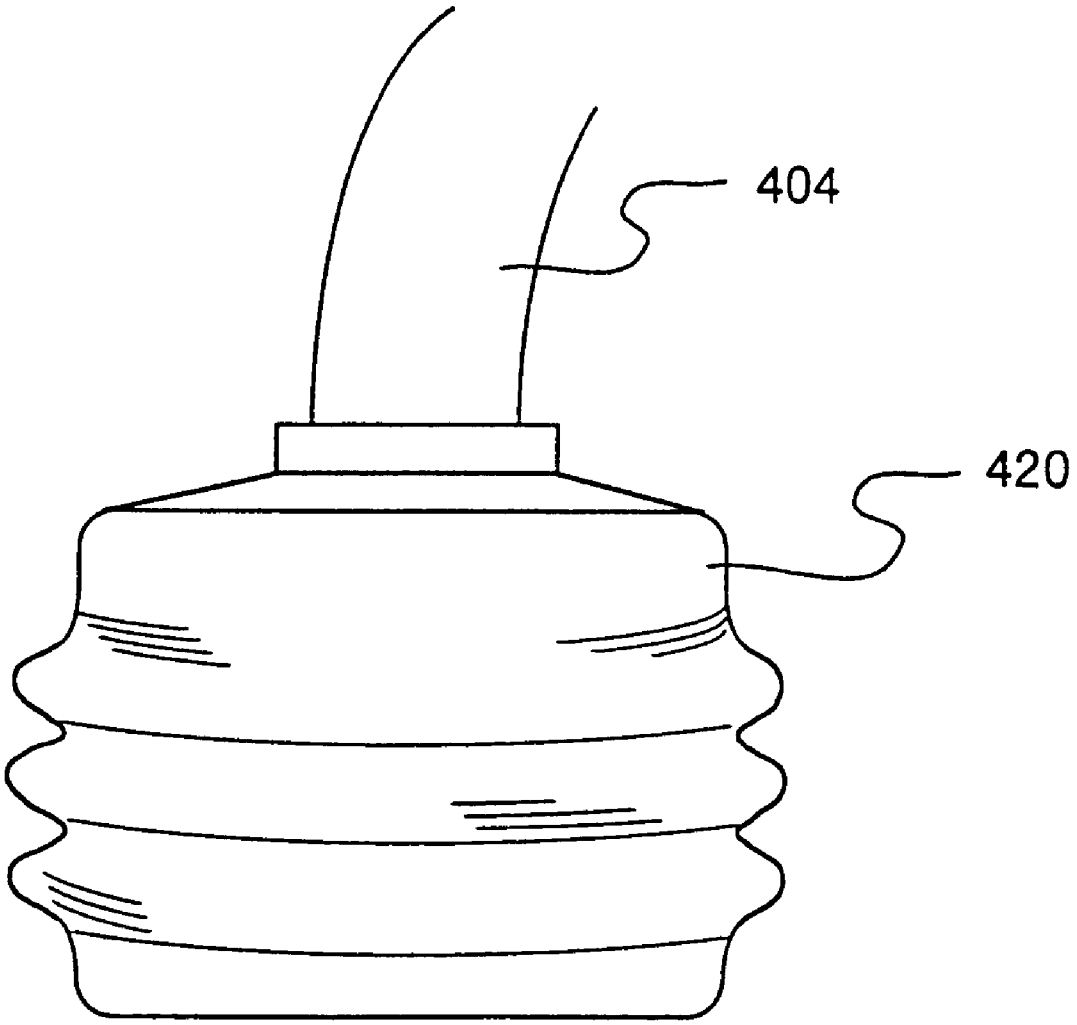
FIG. 34 is a perspective view of a head washing shower brush according to embodiment 16 of the invention.
Figure 35:
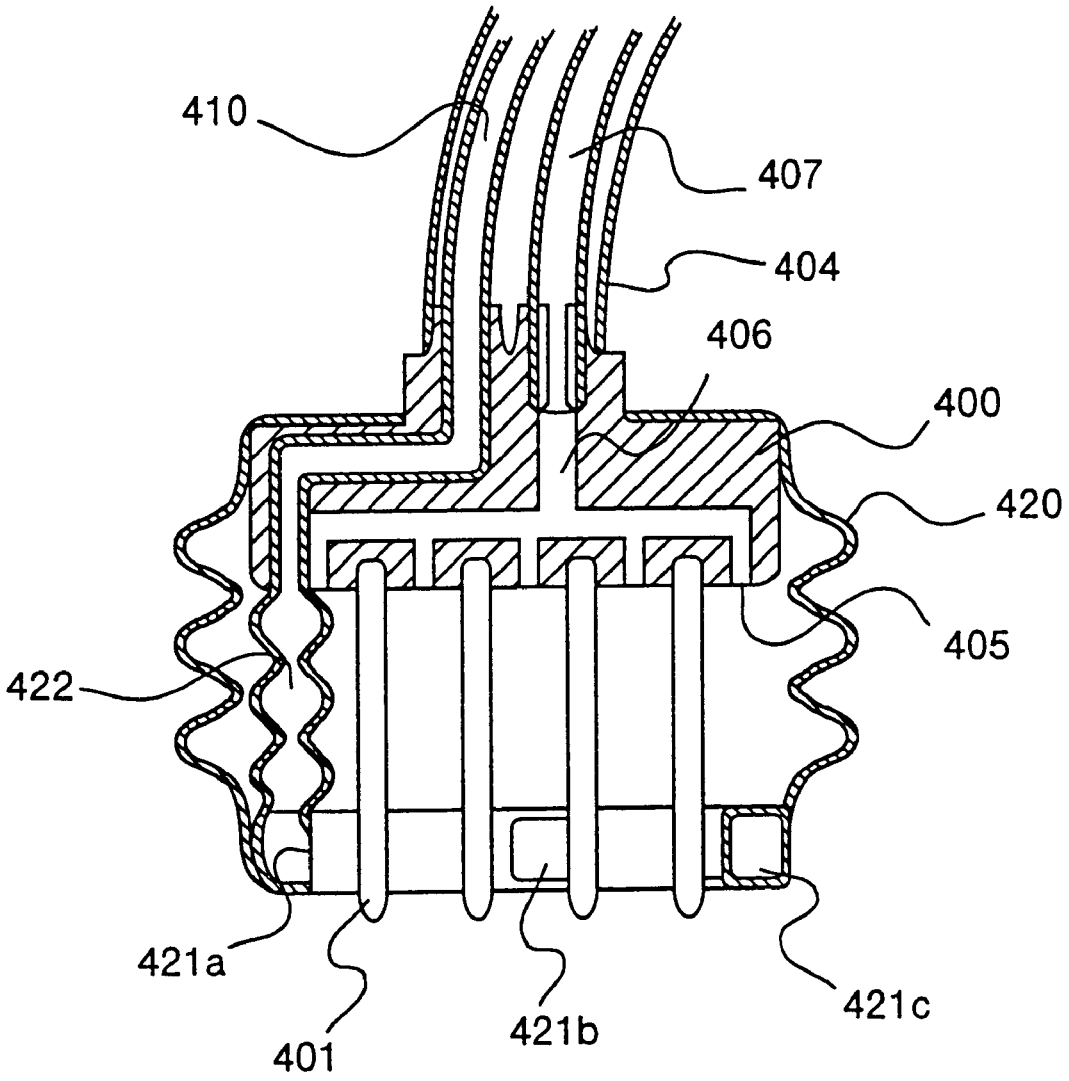
FIG. 35 is a sectional view of the head washing shower brush of embodiment 16.
Figure 36:
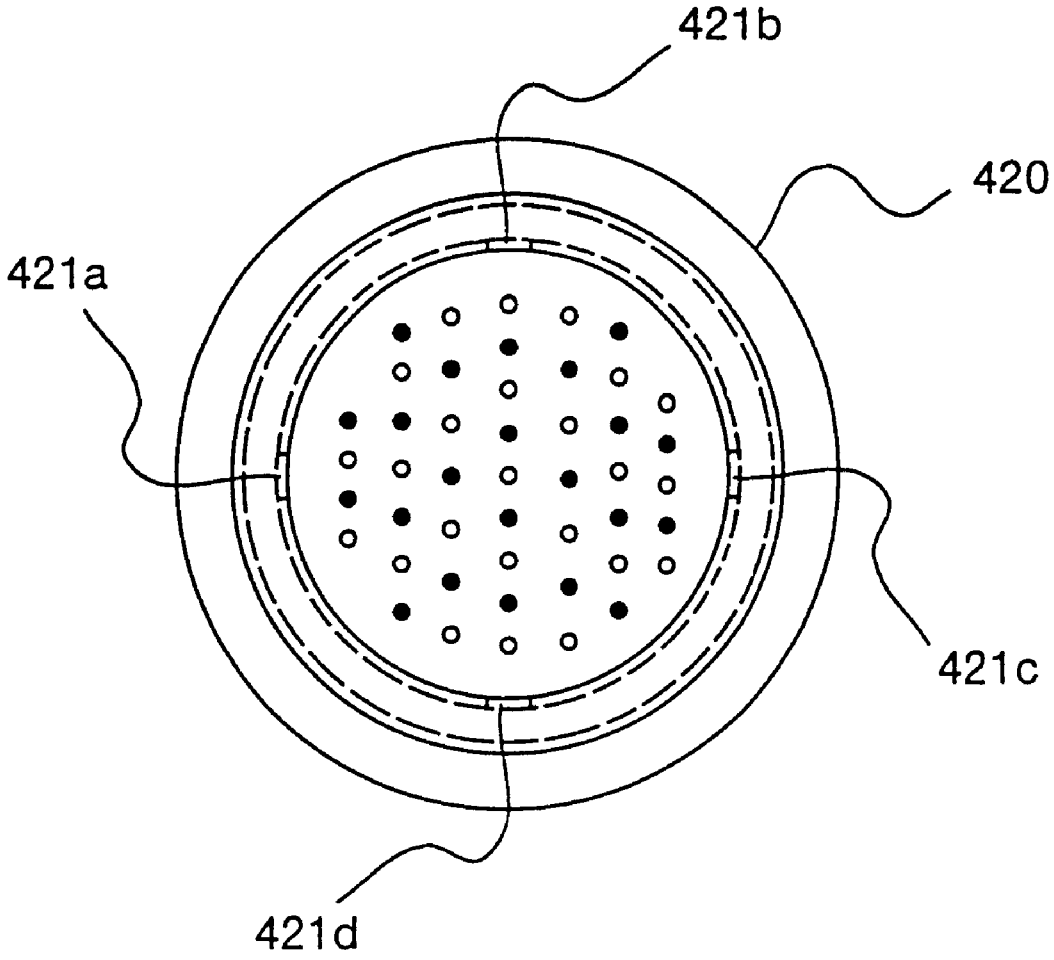
FIG. 36 is a bottom view of the head washing shower brush of embodiment 16.
Figure 37:
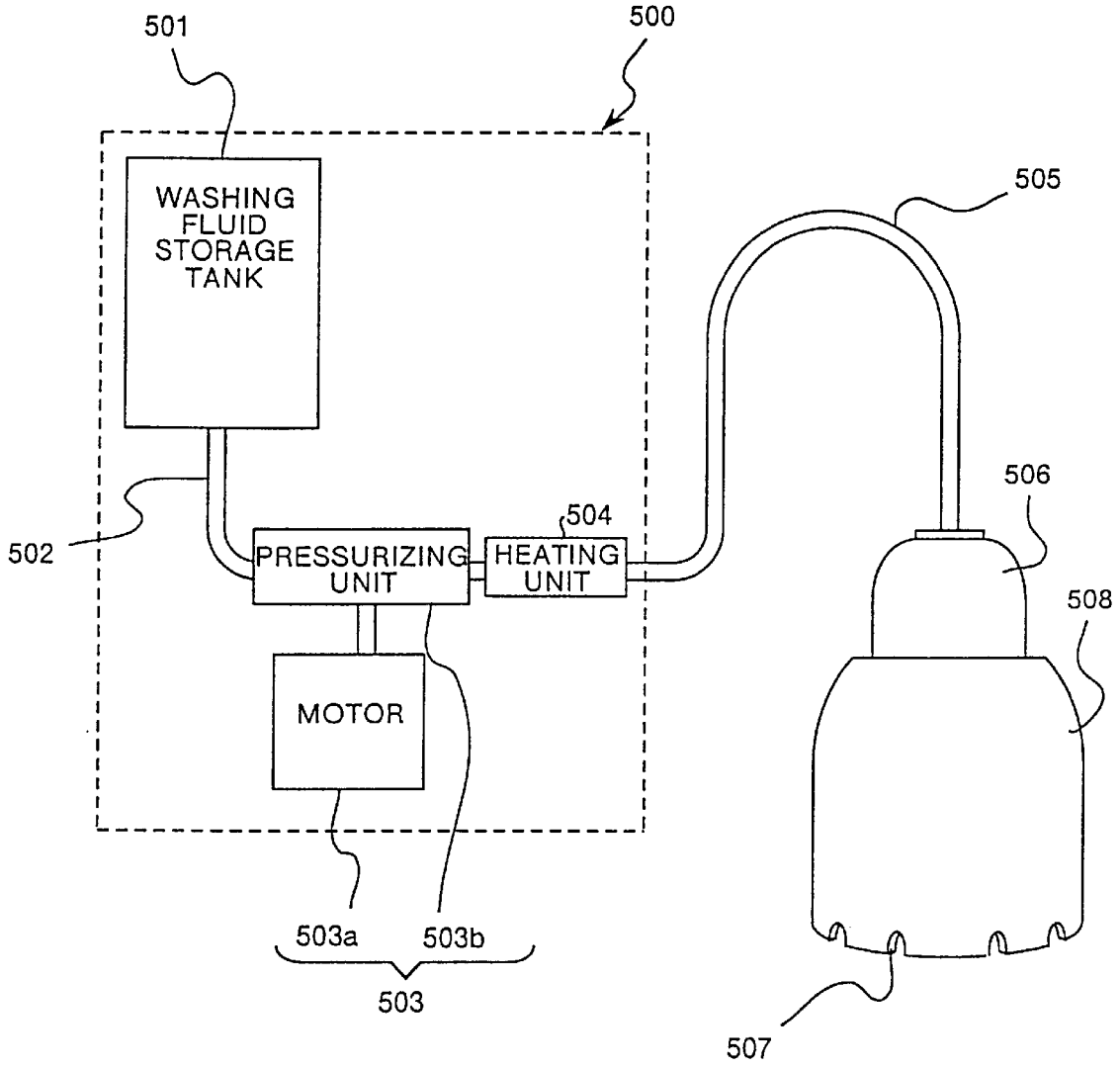
FIG.37 (PRIOR ART)
FIG. 37 is a schematic structural view of a first prior art.
Figure 38:
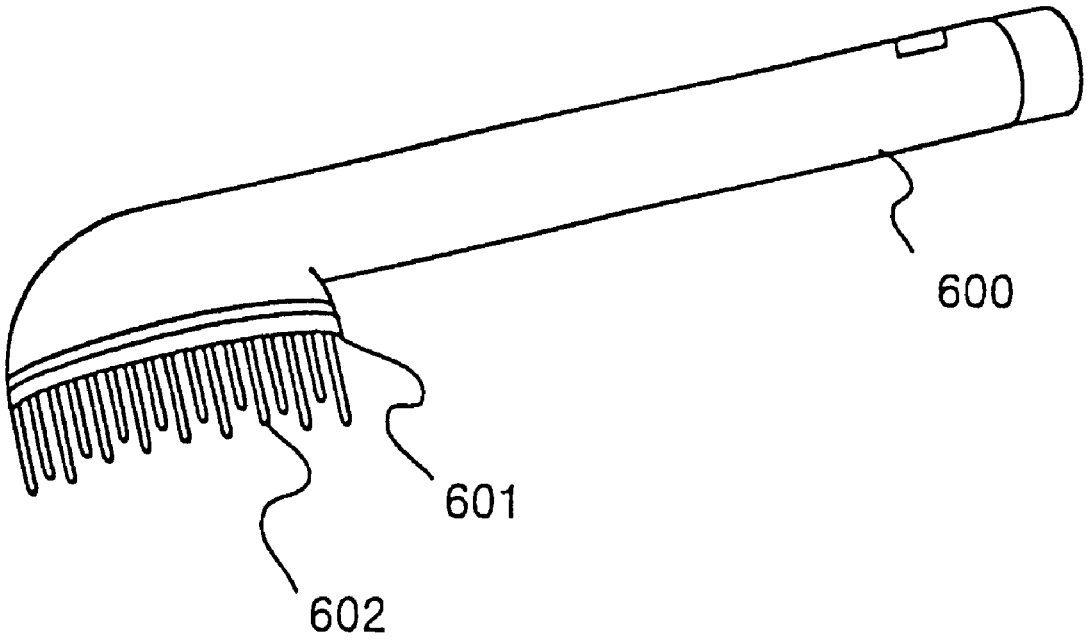
FIG.38 (PRIOR ART)
FIG. 38 is an outline structural view of a third prior art.
Figure 39:
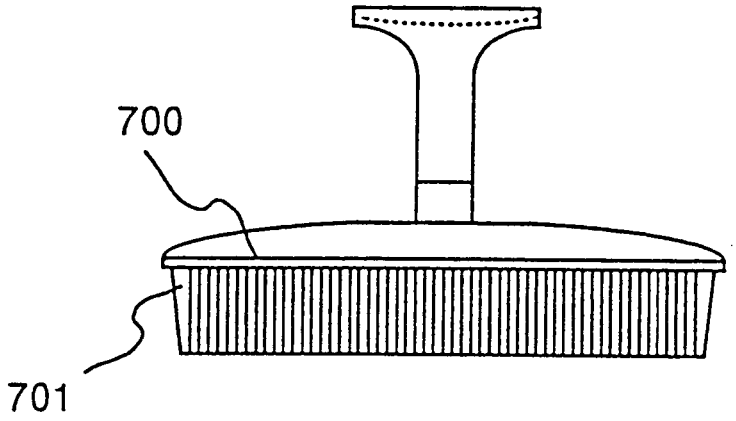
FIG.39 (PRIOR ART)
FIG. 39 is an outline structural view showing side and bottom of a fourth prior art.
Figure 39:
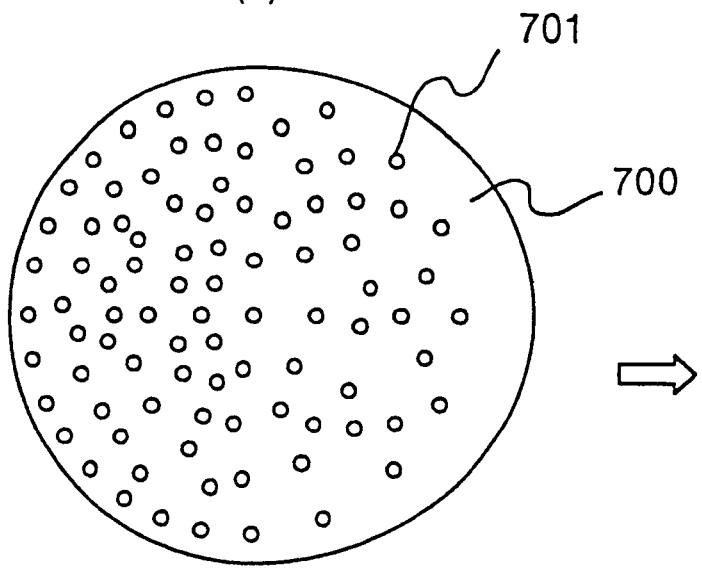
FIG.39 (PRIOR ART)

FIG. 34 and FIG. 36 show a head washing shower brush according to embodiment 16,and FIG. 34 is a perspective view, FIG. 35 is a sectional view, and FIG. 36 is a bottom view. In FIG. 34 and FIG. 36, same pats as in FIG. 29 to FIG. 33 are identified with same reference numerals and explanations are omitted, and only different points are explained herein.

What the head washing shower brush in embodiment 16 differs from embodiment 14 lies in the provision of an expandable flexible cover 420 instead of the flexible tube 402. The lowest part of the elastic cover 420 is tubular, and suction ports 421*a* to 421*d* are provided in this area. In addition, the suction pipe 410 is extended to the position of the suction ports 421*a* to 421*d* (the lowest part of the flexible cover 420) (or it may be composed of a different member), and it is designed to suck the fluid from the suction ports 421*a* to 421*d*. The suction pipe 410 has an expanding portion 422 so as to be expandable depending on the expansion of the flexible cover 420.

The operation at the time of supply and suction of the fluid, it is same as in embodiment 14, and such explanation is omitted herein.

According to the head washing shower brush of embodiment 16, since it is covered with the flexible cover 420, the fluid is prevented from scattering outside completely.

The flexible cover 420 does not interfere brushing, even while brushing, because of its flexibility. If there is unevenness due to hair, it follows up the unevenness, and hence does not interfere brushing, and the fluid can be sucked securely. Moreover, since the suction ports 421*a* to 421*d* are provided in the lowest part of the flexible cover 420, the fluid collected in the flexible cover 420 can be sucked securely without leaking outside.

When the flexible cover 420 is made of sponge or other porous material, it also functions effectively. For example, by sucking the fluid in the sponge, it may be designed to discharge the fluid sucked up by the sponge to outside.

As explained herein, according to the head and face washing apparatus of the invention, the fluid feed passage at least includes first and second fluid feed passages, and the fluid feed means includes first fluid feed means for supplying fluid through the first fluid feed passage and second fluid feed means for supplying fluid through the second fluid feed passage, and therefore the fluid ejected from the fluid ejecting means has at least two different functions, and variation is given to washing, and the convenience of the head and face washing apparatus is enhanced.

According to the head and face washing apparatus of the invention, the fluid ejecting means is a shower head having plural spouts for ejecting the fluid, a first supply passage for supplying the fluid supplied through the first fluid feed passage into the specified spouts, and a second supply passage for supplying the fluid supplied through the second fluid feed passage into the specified spouts, the first fluid feed means supplies the fluid continuously through the first fluid feed passage, the second fluid feed means supplies the fluid intermittently through the second fluid feed passage, the first supply passage supplies the fluid supplied through the first fluid feed passage into the spout disposed on the outer circumference of the shower head, and the second supply passage supplies the fluid supplied through the second fluid feed passage into the other spouts than the spouts supplied with the fluid from the first supply passage, and therefore a wall of water stream is formed by continuous water stream flowing out from the spout of the outer circumference of the shower head, and if using scattering intermittent water stream inside the shower head, scattering of fluid can be prevented. By using continuous water stream for preventing of scattering of fluid, any fluid scatter preventing cover or the like touching the scalp is eliminated, and it is hygienic and comfortable to use. The intermittent water stream used inside of the wall of continuous water stream for prevention of scattering of fluid is higher in washing power than the continuous water stream, and the washing efficiency is enhanced. Since continuous water stream is used for prevention of scattering of fluid, the conventional cover or the like is not needed, and the fluid ejecting means can be reduced in size and weight, and the ease of operation is enhanced.

According to the head and face washing apparatus of the invention, the second fluid feed means, second fluid feed passage, and second supply passage are individually provided in a plurality to correspond to each other, further comprising supply timing control means for controlling the intermittent supply timing of the fluid in every one of the plural second fluid feed means, and therefore fluid can be supplied intermittently at different timings in each second fluid feed means, so that the feeling of use is enhanced by the massage effect of the scalp. Since the massage effect is obtained by the fluid feed timing, the conventional rotating element or the like is not needed, and the fluid ejecting means can be reduced in size and weight, and the ease of operation is enhanced.

According to the head and face washing apparatus of the invention, it further comprises fluid feed control means for adjusting the peak water pressure of the fluid supplied intermittently from the second fluid feed means and ejected from the spouts of the shower head in a range of 3 to 7 $kg/cm^2$, and adjusting the reference number of intermittent pulses for supplying the fluid intermittently in the second fluid feed means in a range of 1600 to 2000 pulses per minute, and therefore the peak water pressure and the number of intermittent pulses can be adjusted in a range excellent in the washing effect and sense of use, so that excellent washing effect and feeling of use may be always obtained.

According to the head and face washing apparatus of the invention, the first and second fluid feed means supply the fluid intermittently through the corresponding first and second fluid feed passages, further comprising supply timing control means for controlling the intermittent supply timing of the fluid individually in the first and second fluid feed means, and therefore fluid can be supplied intermittently at different timings in each one of the first and second fluid feed means, so that the feeling of use is enhanced by the massage effect of the scalp. Since the massage effect is obtained by the fluid feed timing, the conventional rotating element or the like is not needed, and the fluid ejecting means can be reduced in size and weight, and the ease of operation is enhanced.

According to the head and face washing apparatus of the invention, it further comprises fluid feed control means for controlling the fluid feed means so that the water pressure of the fluid ejected from the spout of the fluid ejecting means may be in a range of 3 to 7 $kg/cm^2$, and therefore the washing efficiency and massage effect are enhanced.

According to the head and face washing apparatus of the invention, the fluid feed means supplies the fluid intermittently through the fluid feed passage, and therefore the washing efficiency and massage effect are enhanced.

According to the head and face washing apparatus of the invention, the fluid feed control means controls the fluid feed means so that the reference number of intermittent pulses for supplying the fluid intermittently may be in a range of 1600 to 2000 pulses per minute, and therefore the washing efficiency and massage effect are enhanced.

According to the shower nozzle with hood of the invention, the hood for preventing scattering of water is made of a mesh material, and therefore regardless of the discharge water pressure or discharge water flow from the nozzle, scattering of water is prevented and water can be discharged appropriately.

According to the shower nozzle with hood of the invention, the hood for preventing scattering of water is made of a mesh material disposed in multiple layers, with a space layer interposed between the layers, and therefore regardless of the discharge water pressure or discharge water flow from the nozzle, scattering of water is prevented and water can be discharged appropriately.

According to the shower nozzle with hood of the invention, the hood for preventing scattering of water is made of a porous material, and therefore regardless of the discharge water pressure or discharge water flow from the nozzle, scattering of water is prevented and water can be discharged appropriately. Moreover, since the porous material softly touches the washing surface, and scattering of water is further prevented, and the washing surface is not injured, and the feeling of use is enhanced.

According to the shower nozzle with hood of the invention, the hood for preventing scattering of water includes a first layer made of a soft porous material and a second layer made of a stiff porous material, and the outside of the first layer near the discharge port is covered with the second layer, and therefore regardless of the discharge water pressure or discharge water flow from the nozzle, scattering of water is prevented and water can be discharged appropriately. Moreover, since the porous material softly touches the washing surface, and scattering of water is further prevented, and the washing surface is not injured, and the feeling of use is enhanced. Still more, since the stiff porous material is disposed near the discharge port, the washing operation can be done while holding the second layer, and the working efficiency is enhanced.

According to the shower nozzle with hood of the invention, the hood for preventing scattering of water includes a first layer made of a mesh material and a second layer made of a porous material, with a space layer disposed between the first layer and second layer, and therefore regardless of the discharge water pressure or discharge water flow from the nozzle, scattering of water is prevented and water can be discharged appropriately. Moreover, since the mesh material and porous material are combined, if a soft porous material is used, by making use of the tenacity of the mesh material, it is effective to avoid closure of the nozzle discharge port due to excessive bending of the porous material to the inner side.

According to the shower nozzle with hood of the invention, the hood for preventing scattering of water is formed in a cylindrical shape gradually increasing in the inside diameter from the discharge port side of the shower nozzle toward the washing area side, and therefore the water hitting area can be changed while the hood is abutting against the washing area, so that the washing effect and working efficiency can be enhanced.

According to the shower nozzle with hood of the invention, the hood for preventing scattering of water can be detached from the shower nozzle, and therefore plural water scatter preventing hoods can be prepared and used by exchange, and the standby water scatter preventing hood can be dried and disinfected, and it is very hygienic. In particular, mold and malodor can be prevented, and the feeling of use is improved.

According to the comb type scalp washing tool of the invention, a cover is provided at a position for enclosing the plural discharge ports at least at positions before and after in the comb moving direction, being variable in the height in the vertical direction to the scalp side so as to follow up the scalp surface, and therefore scattering of fluid can be prevented without impeding the motion of the comb.

According to the comb type scalp washing tool of the invention, the cover can be detached from the comb, and therefore the comb and cover can be cleaned easily. When the cover is made of an inexpensive material, the cover may be disposable.

According to the comb type scalp washing tool of the invention, the cover is made of a plastic film, and therefore the cover can be manufactured easily, at light weight and low cost.

According to the comb type scalp washing tool of the invention, the cover is like a brush, and therefore scattering of fluid can be prevented without impeding the combing motion. Further, the feeling of use is soft.

According to the head washing shower brush of the invention, it comprises plural ejecting means disposed at the side of the plurality of comb teeth of the brush base for ejecting the fluid supplied from outside, and plural sucking means disposed so as to surround the plurality of comb teeth at the side of the plurality of comb teeth of the brush base for sucking he fluid ejected by the ejecting means from outside, and therefore since the fluid can be directly applied to the head, it is possible to wash and rinse while brushing. Moreover, the fluid can be sucked while applying the fluid directly in the head, and hence scattering of fluid can be prevented, and fluid is prevented from leaking outside.

According to the head washing shower brush of the invention, the sucking means are made of flexible tubes, and therefore it can follow up the uneven surface if the thickness of the hair is uneven, and scattering of fluid is prevented without impeding the brushing, while the fluid is prevented from leaking outside.

According to the head washing shower brush of the invention, the flexible tubes are formed to have at least two different lengths, and therefore shampoo foams can be sucked effectively.

According to the head washing shower brush of the invention, the flexible tubes are formed so that the opening of the leading end side may be directed to the comb tooth side, and therefore the fluid ejected from the ejecting means can be sucked effectively, and scattering of fluid is prevented, and the fluid is prevented from leaking outside.

According to the head washing shower brush of the invention, it further comprises a flexible cover for surrounding the plurality of comb teeth provided at the side of the plurality of comb teeth of the brush base, in which the sucking means have suction ports provided at the lowest position of the flexible cover and fluid passages for sucking the fluid sucked from the suction ports along the flexible cover, and therefore scattering of fluid is prevented without impeding the brushing, and the fluid is prevented from leaking outside.

INDUSTRIAL APPLICABILITY

As described herein, the head and face washing apparatus, shower nozzle with hood, comb type scalp washing tool, and head washing shower brush of the invention are useful, for example, when shampooing the head of the customers at the beauty parlor or hairdressing salon, or washing specific parts of the body of patients or people unable to bathe in the medical and other care fields because the water (washing fluid) can be applied only in the washing area without scattering to other parts.

What is claimed is:

1. A head and face washing apparatus comprising fluid feed means for supplying fluid through a fluid feed passage, and fluid ejecting means connected to said fluid feed passage, for ejecting the fluid supplied from said fluid feed means, said fluid feed passage at least includes first and second fluid feed passages, said fluid feed means includes first fluid feed means for supplying fluid through said first fluid feed passage and second fluid feed means for supplying fluid through said second fluid feed passage, wherein said fluid ejecting means is a shower head having a plurality of spouts for ejecting said fluid, a first supply passage for supplying the fluid supplied through said first fluid feed passage into specified spouts, and a second supply passage for supplying the fluid supplied through said second fluid feed passage into other specified spouts, said first fluid feed means is adapted to supply the fluid continuously through the first fluid feed passage, said second fluid feed means is adapted to supply the fluid intermittently through the second fluid feed passage, said first supply passage supplies the fluid supplied through the first fluid feed passage into spouts disposed on the outer circumference of said shower head, and said second supply passage supplies the fluid supplied through the second fluid feed passage into other spouts than the spouts supplied with the fluid from the first supply passage.

2. The head and face washing apparatus according to claim 1, wherein said second fluid feed means, second fluid feed passage, and second supply passage are individually provided in a plurality to correspond to each other, further comprising:

supply timing control means for controlling the intermittent supply timing of the fluid in every one of said plural second fluid feed means.

3. The head and face washing apparatus according to claim 1, further comprising:

fluid feed control means for adjusting the peak water pressure of the fluid supplied intermittently from the second fluid feed means and ejected from the spouts of the shower head in a range of 3 to 7 $kg/cm^2$, and adjusting the reference number of intermittent pulses for supplying the fluid intermittently in the second fluid feed means in a range of 1600 to 2000 pulses per minute.

4. The head and face washing apparatus according to claim 1, wherein said other spouts are disposed in spout groups concentric to said outer circumference.

5. The head and face washing apparatus according to claim 1, wherein said other spouts are disposed in spout groups arranged in sectors on the shower head.

6. The head and face washing apparatus according to claim 2, wherein said fluid feed passage further includes at least a third and a fourth fluid feed passage, said fluid feed means further includes at least a third fluid feed means for supplying fluid through said third fluid feed passage and a fourth fluid feed means for supplying fluid through said fourth fluid feed passage, said first fluid feed means is adapted to supply the fluid continuously through the first fluid feed passage, said second fluid feed means is adapted to supply the fluid intermittently through the second fluid feed passage in a repeating cycle represented by fluid supply for one time period and no fluid supply for three additional time periods, said third fluid feed means is adapted to supply the fluid intermittently through the third fluid feed passage in a repeating cycle represented by fluid supply for one time period and no fluid supply for one additional time period, wherein the supply period of the third fluid feed means does not overlap the supply period of the second fluid feed means, said fourth fluid feed means is adapted to supply the fluid intermittently through the fourth fluid feed passage in a repeating cycle represented by fluid supply for one time period and no fluid supply for three additional time periods, wherein the supply period of the fourth fluid feed means does not overlap the supply period of either the second fluid feed means or the third fluid feed means.

7. The head and face washing apparatus according to claim 2, wherein said fluid feed passage further includes at least a third and a fourth fluid feed passage, said fluid feed means further includes at least a third fluid feed means for supplying fluid through said third fluid feed passage and a fourth fluid feed means for supplying fluid through said fourth fluid feed passage, said first fluid feed means is adapted to supply the fluid continuously through the first fluid feed passage, said second fluid feed means is adapted to supply the fluid intermittently through the second fluid feed passage in a repeating cycle represented by fluid supply for one time period and no fluid supply for one additional time period, said third fluid feed means is adapted to supply the fluid intermittently through the third fluid feed passage in a repeating cycle represented by fluid supply for one time period and no fluid supply for one additional time period, wherein the supply period of the third fluid feed means does not overlap the supply period of the second fluid feed means, said fourth fluid feed means is adapted to supply the fluid intermittently through the fourth fluid feed passage in a repeating cycle represented by fluid supply for one half time period and no fluid supply for one additional half time period, wherein the beginning of the supply period of the second fluid feed means and the beginning of the supply period of the third fluid feed means alternatively coincide with the beginning of the supply period of the fourth fluid feed means.

8. A head and face washing apparatus comprising fluid feed means for supplying fluid through a fluid feed passage, and fluid ejecting means connected to said fluid feed passage, for ejecting the fluid supplied from said fluid feed means, said fluid feed passage at least includes first and second fluid feed passages, said fluid feed means includes first fluid feed means for supplying fluid through said first fluid feed passage and second fluid feed means for supplying fluid through said second fluid feed passage, wherein said first and second fluid feed means supply the fluid intermittently through the corresponding first and second fluid feed passages, further comprising:

supply timing control means for controlling the intermittent supply timing of the fluid individually in the first and second fluid feed means.

9. A head and face washing apparatus comprising fluid feed means for supplying fluid through a fluid feed passage, and fluid ejecting means connected to said fluid feed passage, for ejecting the fluid supplied from said fluid feed means, further comprising:

fluid feed control means for controlling said fluid feed means so that the water pressure of the fluid ejected from the spout of the fluid ejecting means may be in a range of 3 to 7 $kg/cm^2$.

10. The head and face washing apparatus according to claim 9, wherein said fluid feed means supplies the fluid intermittently through the fluid feed passage.

11. The head and face washing apparatus according to claim 10, wherein said fluid feed control means controls said fluid feed means so that the reference number of intermittent pulses for supplying the fluid intermittently may be in a range of 1600 to 2000 pulses per minute.

12. A head and face washing apparatus comprising fluid feed means for supplying fluid through a fluid feed passage, and fluid ejecting means connected to said fluid feed passage, for ejecting the fluid supplied from said fluid feed means, said fluid feed passage at least includes first and second fluid feed passages, said fluid feed means includes first fluid feed means for supplying fluid through said first fluid feed passage and second fluid feed means for supplying fluid through said second fluid feed passage, wherein said fluid feed passage further includes at least a third and a fourth fluid feed passage, said fluid feed means further includes at least a third fluid feed means for supplying fluid through said third fluid feed passage and a fourth fluid feed means for supplying fluid through said fourth fluid feed passage, said first fluid feed means is adapted to supply the fluid continuously through the first fluid feed passage, said second fluid feed means is adapted to supply the fluid intermittently through the second fluid feed passage in a repeating cycle represented by fluid supply for one time period and no fluid supply for two additional time periods, said third fluid feed means is adapted to supply the fluid intermittently through the third fluid feed passage in a repeating cycle represented by fluid supply for one time period and no fluid supply for two additional time periods, wherein the supply period of the third fluid feed means does not overlap the supply period of the second fluid feed means, said fourth fluid feed means is adapted to supply the fluid intermittently through the fourth fluid feed passage in a repeating cycle represented by fluid supply for one time period and no fluid supply for two additional time periods, wherein the supply period of the fourth fluid feed means does not overlap the supply period of either the second fluid feed means or the third fluid feed means.

* * * * *